United States Patent [19]

Hermach

[11] Patent Number: 4,677,911

[45] Date of Patent: Jul. 7, 1987

[54] CONVERSION OF LETTERPRESS TO OFFSET PRINTING

[75] Inventor: Carl J. Hermach, Gulfport, Fla.

[73] Assignee: Publishers Equipment Corporation, Carrollton, Tex.

[21] Appl. No.: 747,383

[22] Filed: Jun. 21, 1985

Related U.S. Application Data

[63] Continuation of Ser. No. 473,967, Mar. 10, 1983, abandoned, which is a continuation-in-part of Ser. No. 209,222, Nov. 24, 1980, abandoned, which is a continuation-in-part of Ser. No. 175,126, Aug. 4, 1980, abandoned, which is a continuation-in-part of Ser. No. 122,908, Feb. 20, 1980, abandoned.

[51] Int. Cl.[4] ..... B41F 5/06; B41F 5/22

[52] U.S. Cl. ..... 101/218; 101/221; 101/177

[58] Field of Search ..... 101/177–185, 101/247, 351, 352, 216, 217, 218, 219–222, 152, 153, 137–139, 140–145; 308/62, 121

[56] References Cited

U.S. PATENT DOCUMENTS

| | | | |
|---|---|---|---|
| 1,647,387 | 11/1927 | Wood | 101/220 |
| 2,568,761 | 9/1951 | Peyrebrune | 101/218 |
| 2,986,086 | 5/1961 | Siebke | 101/218 |
| 3,072,050 | 1/1963 | Wolff | 101/177 |
| 3,361,490 | 1/1968 | Bassan | 308/62 X |
| 3,470,816 | 10/1969 | Piecha et al. | 101/216 |
| 3,732,813 | 5/1973 | Sighn et al. | 101/247 X |
| 3,785,287 | 1/1974 | Dahlgren | 101/247 |
| 4,000,242 | 12/1976 | Hartbauer | 101/216 X |

*Primary Examiner*—J. Reed Fisher
*Attorney, Agent, or Firm*—Robert V. Jambor

[57] ABSTRACT

An offset press unit which has a main frame defining a pair of spaced apart walls having bores therein, a pair of plate cylinders are disposed within the frame and are rotatably supported in spaced apart relation, and a pair of blanket cylinders are disposed within the frame each is rotatably supported for rolling contact with the other and with one of said plate cylinders, internal support means are secured to one of the walls and include at least one cylinder supporting bearing, external support means are secured to the other of said walls including at least one cylinder supporting bearing and one of the printing cylinders is rotatably supported by the cylinder supporting bearings.

A method of constructing the offset press unit includes providing rotatable support for at least one printing cylinder by providing an internal support means having at least one cylinder supporting bearing and securing said internal support means to one of said walls of said main frame, providing an external support means having at least one cylinder supporting bearing and securing said external support means to the other of the walls with at least one of the cylinders supported upon the cylinder supporting bearings of the internal and external support means.

14 Claims, 26 Drawing Figures

491
492
56a
490a
493
495d
495e
497
496
495f
495g
619
621
52c
468
468c
468b
498
59b
55
495b
495c
456
468a
495
495a
494
492
54c
12a

CONVERSION OF LETTERPRESS TO OFFSET PRINTING

DESCRIPTION

This application is a continuation of U.S. application Ser. No. 473,967 filed Mar. 10, 1983, now abandoned, which is a continuation-in-part of U.S. application Ser. No. 209,222 entitled "Conversion of Letterpress to Offset Printing", filed Nov. 24, 1980, now abandoned, which is a continuation-in-part of U.S. application Ser. No. 175,126 entitled "Conversion of Letterpress to Offset Printing", filed Aug. 4, 1980, now abandoned which is a continuation-in-part of U.S. application Ser. No. 122,908 entitled "Conversion of Letterpress to Offset Printing", filed Feb. 20, 1980, now abandoned.

TECHNICAL FIELD

The present invention relates generally to printing presses, and in one of its aspects, to a method and apparatus for converting a web fed letterpress unit into a web fed offset printing press unit.

The news publishing industry has billions of dollars worth of letterpress equipment. The newspaper industry has, however, been switching from letterpress to offset printing for numerous reasons including improved quality of the print and lowered operating cost. Until recently, publishers have had little option other than to purchase new offset equipment to replace their letterpress equipment.

The frames for the letterpress units are massive and reboring the frames in place for insertion of offset cylinders is impractical. Often reboring is impossible because the new bores would overlap the old bores. Moreover, completely replacing the equipment or completely reworking it is very time consuming.

BACKGROUND ART

A conversion known as direct lithographic or "di-litho" simply replaces the letterpress plate and impression cylinders with offset plate and blanket cylinders. In the di-litho process, the web is fed between the dilitho plate and blanket cylinders so that the process is not a true offset printing process.

In accordance with an invention of the present inventor and Duane H. Houy, which is the subject matter of U.S. patent application Ser. No. 32,240, filed Apr. 20, 1979, and assigned to the same assignee as the present invention, a method for converting a web fed letterpress unit having a main frame, a pair of plate cylinders laterally spaced in the frame for mounting printing plates thereon, means for applying films of ink to the plates, and a pair of impression cylinders in respective rolling contact with the plates on the plate cylinder, into a web fed offset printing press unit includes removing the pair of letterpress plate cylinders and the pair of letterpress impression cylinders. Internal support means for rotatably supporting offset cylinders in the offset printing configuration with a bearing internal to the main frame is affixed to the main frame. One embodiment of the internal support means includes an auxiliary frame. A lower portion of an auxiliary frame for receiving offset cylinders in an offset printing press configuration is placed inside the main frame. A pair of offset plate cylinders is then installed. The offset plate cylinders might fit into the bores and bearings for the letterpress plate cylinders in which case they can be installed directly, otherwise one or both of the offset plate cylinders is installed in the auxiliary frame. The lower portion of the auxiliary frame is then installed, using pilots to guide the installation of the auxiliary frame. The pilots, in one embodiment, are affixed to the auxiliary frame and are designed to be inserted into the original cylinder bores of the main frame. After the auxiliary frame is installed, a pair of blanket cylinders is installed in close proximity to a position for respective rolling contact with the plates on the plate cylinder and the other blanket cylinder. In some circumstances the lower portions of the auxiliary frame are completely installed prior to the installation of the plate cylinders.

It is common for letterpress units to also have a pair of laterally spaced form rollers in respective rolling contact with the plates on the plate cylinder. A preferred conversion according to that method includes removing at least one pair of form rollers, and mounting micrometric adjusting sockets for receiving the form rollers for respective rolling contact between at least one pair of form rollers with the plates of the plate cylinder after the pair of offset plate cylinders is installed. It is also preferred to plate the ink drums with copper, and add dampener motions.

The gear train used to drive the letterpress unit cylinders is not suitable for driving the offset cylinders. A new offset gear train must, therefore, be installed for imparting motion from one of the offset press unit cylinders to other offset press unit cylinders. Some of the gears for the letterpress unit can be removed, but many will still be used for driving at least one of the cylinders and for driving the inking drums. In converting some letterpress units, it will be possible to extend the shaft of the offset cylinders through the bores for the letterpress unit cylinders in the main frame by removing the bearings for the letterpress cylinders. In such a case, the offset gear train can normally be installed on the outside of the main frame to allow more room inside the frames for wider web widths. With the cylinder shafts supported by the auxiliary frame inside the main frame, unwanted vibrations are caused by supporting the weight of the gears on the outside of the main frame. Otherwise, the offset gear train can be installed inside of the main frame, but installation of the gear train inside the main frame makes it difficult to access the gears for maintenance and impossible to remove the gears without removing the upper portions of the auxiliary frame and the cylinders.

Considering the cylinders to include both the drum body and the shaft, it is frequently necessary to make the drum bodies for the offset press shorter than the drum bodies were for the letterpress in order to allow additional room for the auxiliary frame and the offset gear train when it is inside the main frame. This shortening of the drum bodies narrows the allowable web width, but this normally does not present a problem in the United States since the industry has fairly well settled on a 58 inch web width which is sufficiently narrower than the typical 68 inch web width for which most letterpress units were designed. This does, however, present a problem in Europe and other countries that still use a wider web width. The total length of the cylinders is also shorter when the shafts cannot extend through the main frame bores for the letterpress cylinders.

A preferred conversion according to that method and apparatus includes the installation of means for bodily swinging various cylinders into different positions for different printing arrangements and for throw-off in case of web wrap, for changing plates, or other cylinder maintenance.

A special method according to that invention for converting a letterpress unit that has at least a half deck with a deck plate cylinder and a deck impression cylinder is to remove the deck impression cylinder, install a deck blanket cylinder in a position for rolling contact with the plates of the deck plate cylinder, if necessary replacing the deck plate cylinder with a deck offset plate cylinder, and installing an impression cylinder in the vicinity of the cusp formed by the pair of blanket cylinders for placing in rolling contact with the deck blanket cylinder and for placing in rolling contact with all three cylinders, the deck blanket cylinder and the pair of offset blanket cylinders. This method also includes the situation where there is a full deck, the full deck being simply two half decks.

In a conversion involving at least one half deck, a means is installed for bodily swinging each of the blanket cylinders and the impression cylinder between a first position in which the blanket cylinders make contact with the plates of their respective plate cylinders and with the impression cylinder, a second position in which the pair of blanket cylinders make contact with each other and are isolated from the impression cylinder, and the deck blanket cylinder makes contact with the impression cylinder, and a third position in which the blanket cylinders and the impression cylinder are displaced into a throw-off position in which the blanket cylinders are isolated from their associated cylinders. Such a method can also include installing a means for bodily swinging the remaining offset cylinders wherein all offset cylinders are displaced in the third position.

DISCLOSURE OF THE INVENTION

A method according to the present invention will also include providing bores in the main frame for receiving the shafts of offset cylinders in an offset printing press configuration, and installing an external support means affixed to the main frame for rotatably supporting offset cylinders with a bearing outside the main frame. One such external support includes a lower portion of an external auxiliary frame on the outside of the main frame for receiving the offset cylinders. An upper portion of the external auxiliary frame could be installed at the same time so that the shafts of the offset printing cylinders are slid through the bores in the external auxiliary frame, although it is preferable to install the upper portion of the frame along with the upper portions of the internal auxiliary frame after the cylinders have been lowered into position. Providing bores in the main frame for receiving the shafts of the offset cylinders includes taking advantage of the already existing bores for the letterpress cylinders, enlarging those bores where necessary, and forming new bores where necessary. These do not have to be precision bores and can be quite rough since the offset cylinders will be supported by the auxiliary frames in most cases, and simply need to pass through the main frame.

In one combination according to the present invention, the internal support means includes support brackets which support the offset cylinders, each support bracket associated with a particular bore. Pilots are affixed to the brackets for positioning the brackets with respect to their respective bores. In one embodiment, the external support means also includes such support brackets and pilots. The brackets receive at least one end of the cylinder shafts for the offset cylinders which have been relocated with respect to the letterpress cylinders which they replace.

These and other objects, advantages and features of this invention will be apparent from the following description taken with reference to the accompanying drawings, wherein is shown the preferred embodiments of the invention.

BEST MODE FOR CARRYING OUT THE INVENTION

Figure 1:
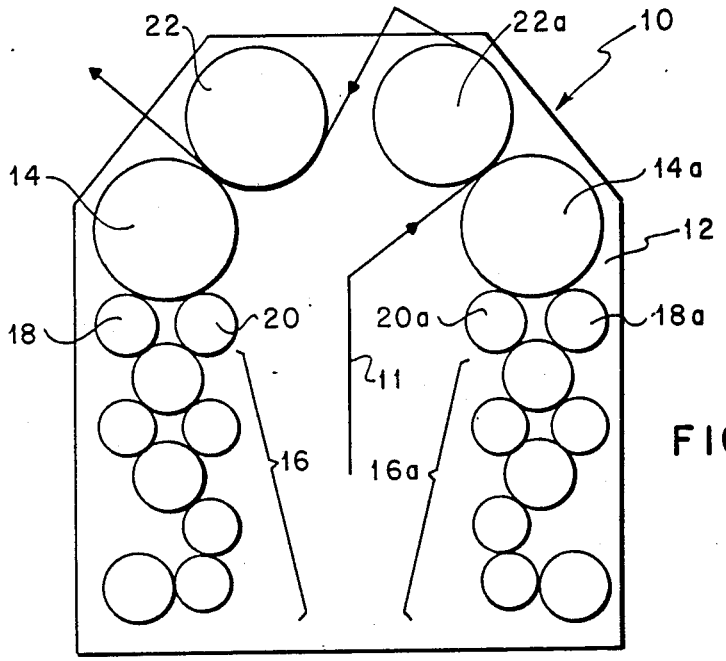
FIG. 1 is a diagramatic cross-sectional view taken from one end of a web fed letterpress unit.

Referring now to the drawing, and in particular to FIG. 1, a typical web fed letterpress unit, referred to generally by reference numeral 10 prints on both sides of a web 11. Letterpress unit 10 includes a main frame 12, a pair of plate cylinders 14 and 14*a* laterally spaced in frame 12 for mounting printing plates thereon, means including ink transfer rollers and cylinders or drums 16 and 16*a* and form rollers 18, 18*a*, 20 and 20*a* for applying films of ink to the plates. Letterpress unit 10 also includes a pair of impression cylinders 22 and 22*a* in respective rolling contact with the plates on the plate cylinder 14 and 14*a*, respectively.

Figure 2:
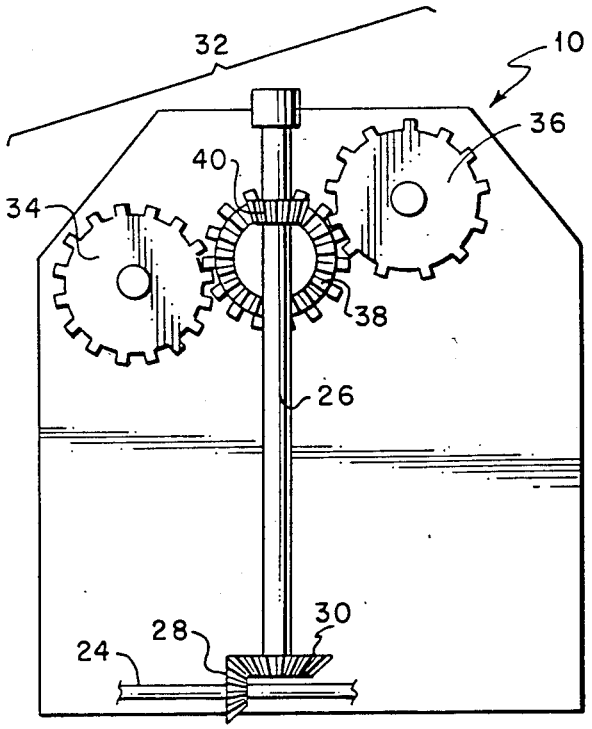
FIG. 2 is a diagramatic end view of the letterpress unit of FIG. 1.

Referring also to FIG. 2, the letterpress unit is driven by a horizontal shaft 24 which drives a vertical drive shaft 26 through bevel gears 28 and 30. Vertical drive shaft 26 in turn drives the letterpress cylinders through gear train 32, which includes a spur drive gear 34 for cylinder 14, a spur drive gear 36 for impression cylinder 22*a* and a spur gear-bevel gear combination 38 driven by vertical shaft 26 through bevel gear 40. On the far end of frame 12 are mounted spur gears corresponding to each of the plate cylinders 14 and 14*a* and each of the impression cylinders 22 and 22*a* so that the gear for plate cylinder 14 drives the gear for impression cylinder 22, and the gear for impression cylinder 22*a* drive the gear for plate cylinder 14*a*.

Figure 3:
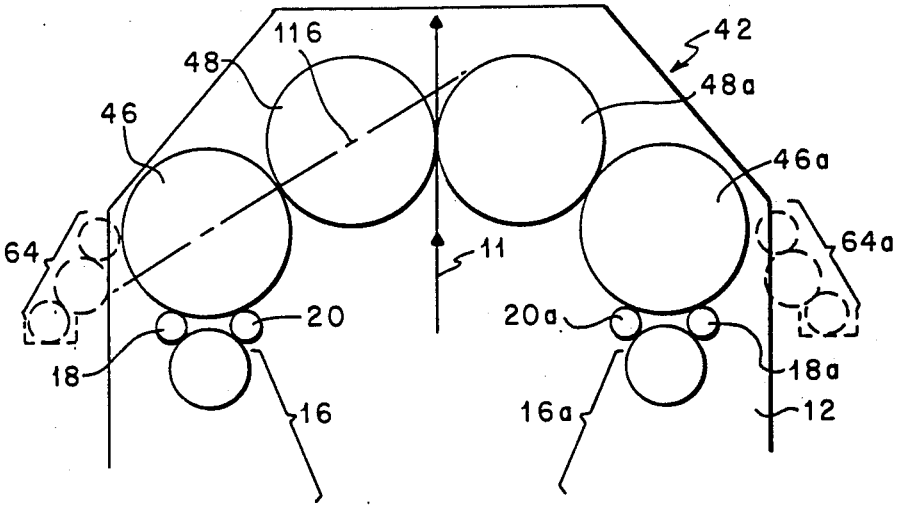
FIG. 3 is a diagramatic sectional view similar to that of FIG. 1 of the press of FIG. 1 after it has been converted to a web fed offset printing press unit.
Figure 4:
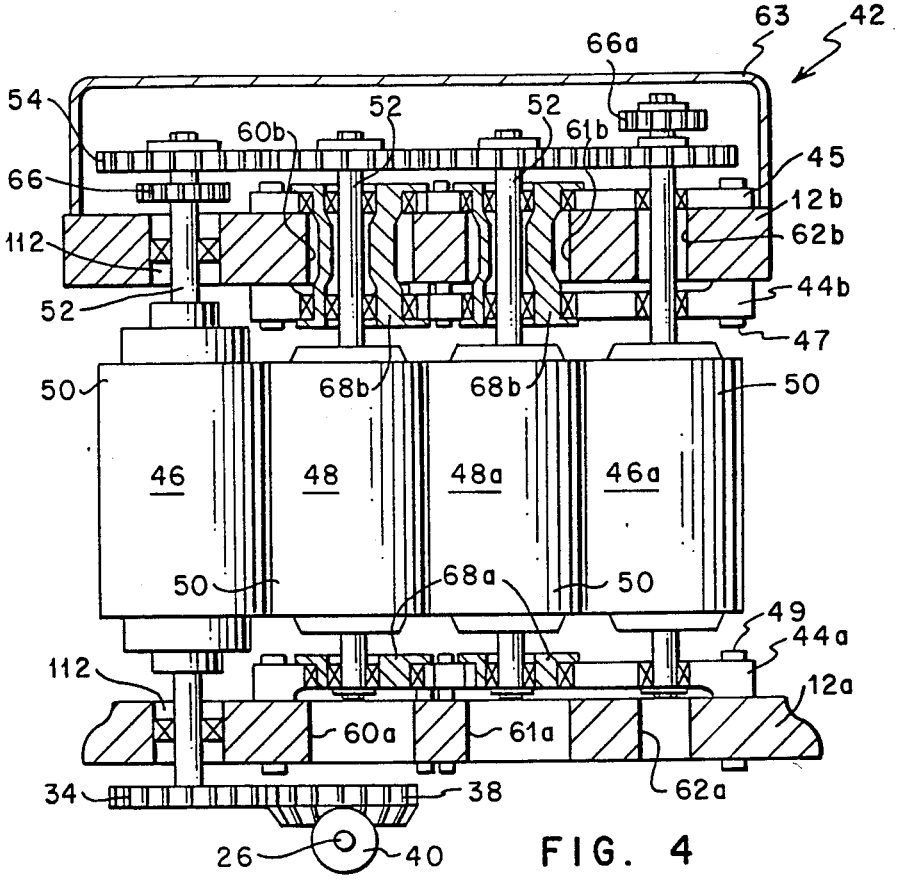
FIG. 4 is a top view of the offset printing press unit of FIG. 3 partly in section to show the bores in the press main frame.

Referring now to FIGS. 3 and 4, a web fed offset printing press unit converted from web fed letterpress unit 10 of FIGS. 1 and 2 is referred to generally by reference numeral 42. It includes main frame 12 comprising drive side main frame 12*a* and operating side main frame 12*b*, ink transfer rollers and drums 16 and 16*a*, and form rollers 18, 18*a*, 20 and 20*a*. It also includes the same driving mechanism through vertical shaft 26, bevel gear 40, combination spur gear-bevel gear 38 and spur gear 34. Offset press unit 42, however, also has an internal support means for rotatably supporting cylinders in an offset configuration, in this embodiment internal support means includes an internal auxiliary frame 44, affixed to main frame 12, comprising drive side internal auxiliary frame 44*a* and operating side internal auxiliary frame 44*b* inside main frame 12 for receiving cylinders. The internal support means is internal in that it has bearing inside the main frame. A pair of offset plate cylinders 46 and 46*a* are laterally spaced inside the frames for mounting printing plates thereon, and a pair of blanket cylinders 48 and 48*a* are inside the frames in close proximity to a position for rolling contact with the plates on the respective plate cylinder, cylinder 46 or 46*a*, and each other. Considering cylinder 46 to include a drum 50 and a shaft 52, it can be seen that the shaft for some cylinders extends beyond auxiliary frame 44 and even beyond main frame 12. The cylinders are thus "inside the frames" in the sense that they are primarily between drive side main frame 12*a* and operating side main frame 12*b*.

Offset unit 42 also includes an external support means for rotatably supporting offset cylinders, external support means in this embodiment includes an external auxiliary frame 45 affixed to the outside of main frame 12. In the particular embodiment illustrated, external auxiliary frame 45 and operating side internal auxiliary frame 44*b* are bolted to operating side main frame 12*b* by bolts 47. Similarly, drive side internal auxiliary frame 44*a* is bolted to drive side main frame 12*a* by bolts 49.

Web fed offset printing press unit 42 also includes a gear train 54 outside of operating side main frame 12*b* for imparting motion from one of the cylinders, cylinder 46 in this case, to other cylinders, in this case cylinders 48, 48*a* and 46*a*. It may be necessary to shorten drums 50 of the cylinders somewhat in order to allow more room within main frame 12 for auxiliary frame 44. Gear train 54 can be moved outside of main frame 12 even if the shafts 52 of cylinders 46, 46*a* 48 and 48*a* do not align with bores 76, 60*a*, 56*b*, 61*a* and 58*b* for the letterpress unit cylinders since bores 60*b*, 61*b*, and 62*b* have been provided by enlarging the original bores. Insome cases bores for offset cylinders are provided by simply removing the bearings for the letterpress cylinders. Many letterpress units have enough room in existing oil tight housing 63 for the addition of gear train 54. In the embodiment illustrated, it is possible to keep gear train 54 closer to the bearing supports for shafts 52 by moving inking gear 66*a* to the outside of gear train 54, thus further reducing gear overhang.

A method for converting web fed letterpress unit 10 of FIGS. 1 and 2 into web fed offset printing press unit 42 of FIGS. 3 and 4 comprises in combination the steps of removing the pair of letterpress plate cylinders 14 and 14*a* and the pair of letterpress impression cylinders 22 and 22*a*, placing inside main frame 12 a lower portion of an internal auxiliary frame 44 comprising drive side internal auxiliary frame 44*a* and operating side internal auxilary frame 44*b* for receiving offset cylinders in an offset printing press configuration, installing a pair of offset plate cylinders 46 and 46*a*, installing the lower portion of auxiliary frame 44, and installing a pair of blanket cylinders 48 and 48*a* in close proximity to a position for respective rolling contact with the plates on plate cylinder 46 and 46*a* respectively and the other blanket cylinder. The lower portions of the auxiliary frames can, of course, be completely installed prior to installing the cylinders, and the invention is not limited to the particular order of operations. It is simply easier to at least have the lower portions already inside the main frame before the cylinders are in place.

A preferred method according to the present invention also includes installing a lower portion 45*b* of an operating side external auxiliary frame and installing an offset printing configuration gear train 54 on the outside of operating side external auxiliary frame 45. The method also includes, prior to installing the lower portion of any auxiliary frame, positioning a template representative of that auxiliary frame against the respective side of the main frame, and with the template as a guide, forming holes in the main frame for bolting the auxiliary frame to the respective side of the main frame. Installing an auxiliary frame includes bolting the auxiliary frame to the main frame with bolts 47.

The method also includes installing means 68 for bodily swinging cylinders through short radius arcs, which in the embodiment illustrated are eccentric sleeves, in the auxiliary frames extending from internal auxiliary frame 44*b* to external auxiliary frame 45 through bore holes 60*b* and 61*b* of main frame 12*b* for rotatably receiving the respective offset cylinders. Eccentric sleeves 68 on the drive side are simply rotatably mounted in drive side auxiliary frame 44*a*. The step of providing bores in main frame 12 comprises, where necessary, enlarging the bore sufficiently for receiving the eccentric sleeves on the operating side.

A preferred method includes removing at least one pair of form rollers, either 18 and 18*a* or 20 and 20*a* or both pairs, mounting micrometric adjusting sockets for receiving the form rollers for respective rolling contact by the form rollers with the plates of plate cylinders 46 and 46*a* after the pair of offset plate cylinders is installed, and then installing at least one pair of form rollers. It is also preferred that the ink drums of 16 and 16*a* be plated with copper, and that dampeners 64 and 64*a* along with dampener motions be added. Gear train 54 is also added. Gears 66 and 66*a* are added to plate cylinders 46 and 46*a* respectively for driving the inking rollers and drums. Means 68 for bodily swinging each of blanket cylinders 48 and 48*a* is installed. Means 68 is for bodily swinging the cylinders between a first position in which the blanket cylinders make contact with their respective plate cylinders and with each other for applying an inked image on opposite sides of a web fed between them, and a second position in which the blanket cylinders are displaced into a throw-off position in which the blanket cylinders are isolated from their associated cylinders. Means 68 can be manually or hydraulically turned eccentric bearings. Such mechanisms are common in printing presses and are described in detail in U.S. Pat. No. 3,329,086, issued to Pullen. Means 68 can also be installed for bodily swinging each of the plate cylinders, and the positions mentioned can be accomplished by bodily swinging both plate cylinders and blanket cylinders.

Figure 5:
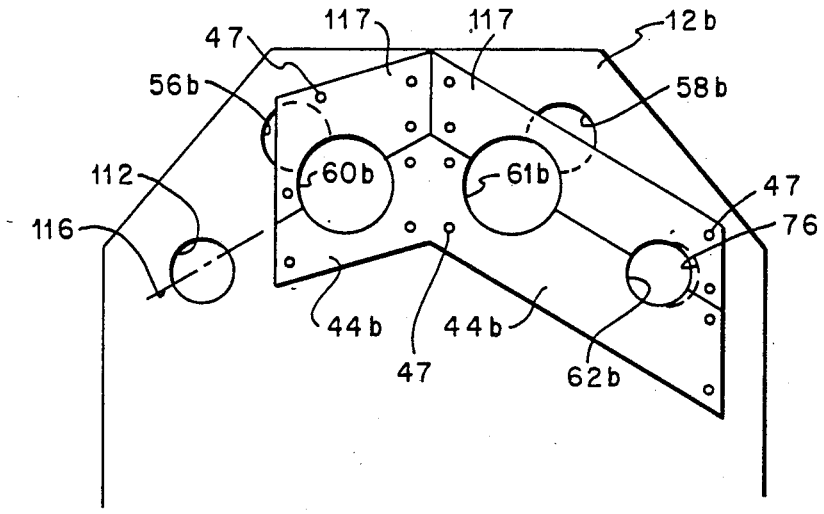
FIG. 5 is a view similar to that of FIG. 3 of the offset press unit of FIGS. 3 and 4 with cylinders removed.

Only a lower portion of auxiliary frames 44 and 45 has been discussed, and in some situations this may be the entire auxiliary frame. Referring again to FIGS. 3 and 5, another embodiment of a lower portion of auxiliary frame 44 will leave the bores for the cylinders exposed so that the offset cylinders can simply be lowered into place. The location of the top of such a lower portion is illustrated by line 116. A cap 117 is then attached to hold the cylinders and their respective bearings in place. This is similar to the common practice of capping main frames.

It can now be seen that the present invention allows the removal of gears to the outside of the converted press frame which allows more room for the cylinders and, thus, a wider web width. It also reduces the cost of conversion from letterpress to offset printing. Having a third bearing surface on the operating side reduces the length of the gear overhang. The same apparatus could, of course, be used for reducing gear overhang on driving side gears. Moving the gears to the outside also allows more space for sockets and throw-off mechanisms. The present invention takes advantage of the exising oil tight housing on the operating side of the press unit. The present invention can easily be applied to color units and other units having a half deck or full deck. The present invention permits the use of smaller and double bearings on the blanket cylinders. The present invention also permits the use of rough bored holes in the main frame when necessary to enlarge or add bores. This is extremely important because of the difficulty of precision drilling holes in the main frame on site. Additionally, keeping the gears on the outside of the main frame allows the bearing surfaces on the internal auxiliary frame to be closer to the main frame, thus reducing the stress on the auxiliary frame.

Figure 7:
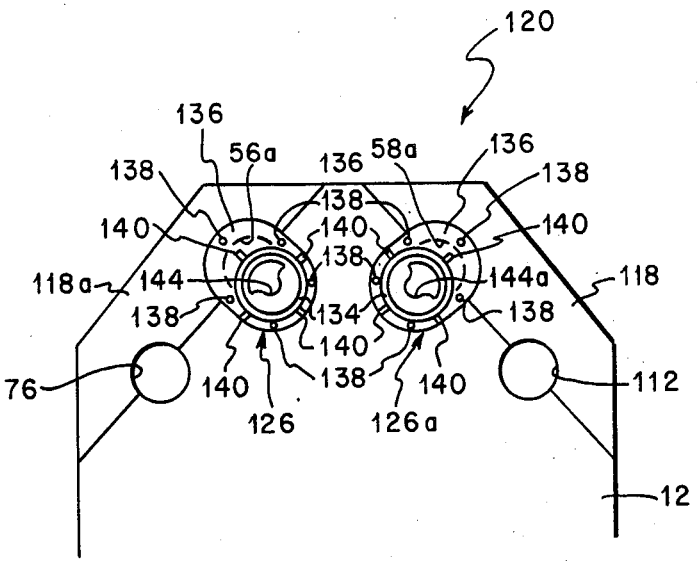
FIG. 7 is a view similar to that of FIG. 3 except of the drive side of the offset press unit of FIG. 6 with the cylinders removed.
Figure 6:
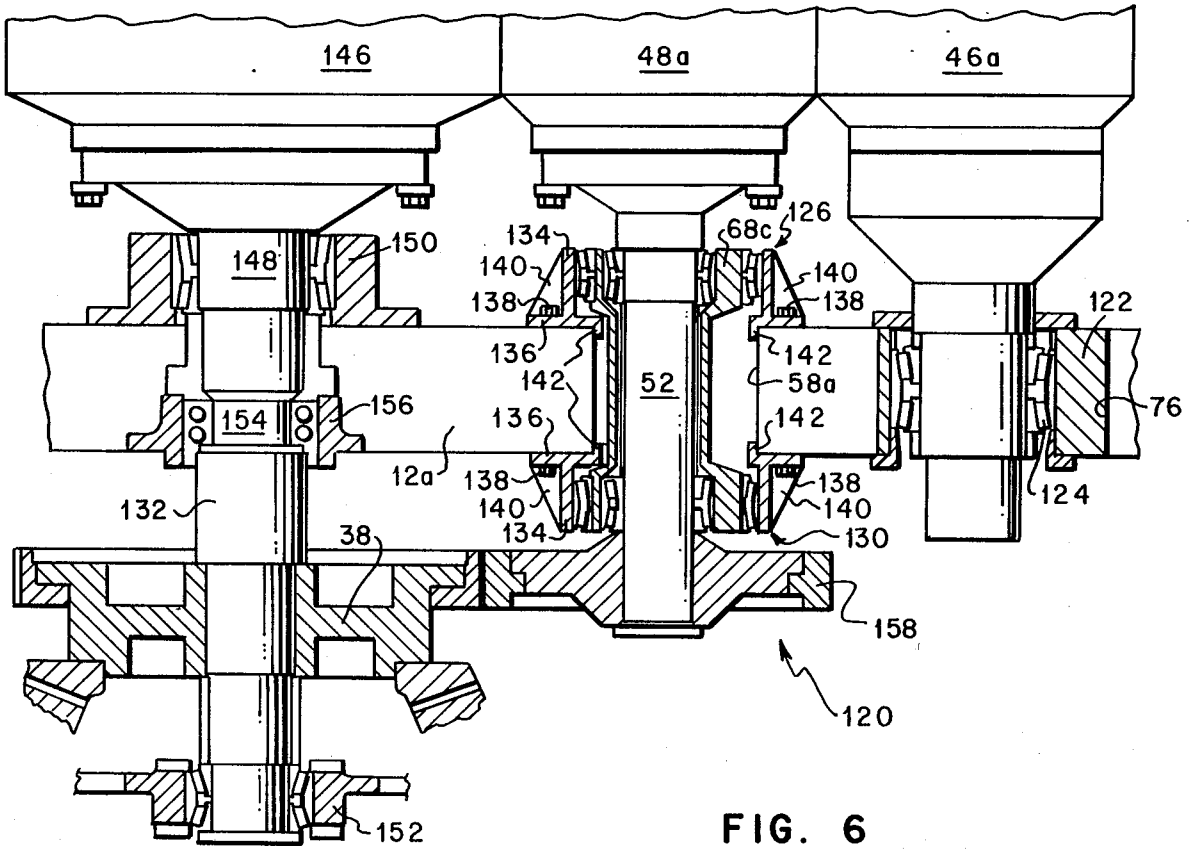
FIG. 6 is a detail of a view similar to the view in FIG. 4 of an alternative embodiment, but taken at a right angle to the exposed edge of the main frame where the cap has been removed.

Referring now to FIG. 6 and FIG. 7, an alternative embodiment according to the present invention is referred to generally by reference numeral 120. In the description, like parts are given like numbers to those used in the descriptions of other embodiments. Main frame 12 has caps 118 and 118*a* which can be removed and which were originally used to aid in inserting letterpress cylinders into bores 112, 56*a*, 58*a* and 76. In embodiment 120 illustrated, plate cylinder 46*a* is rotatably supported by eccentric sleeve 122 and beveled roller bearings 124. The center of plate cylinder 46*a* in this case is moved sufficiently for proper location by means of eccentric sleeve 122 so that it is not necessary to enlarge bore 76 or install plate cylinder 46*a* in an auxiliary frame or other internal or external support means. The internal support means in this embodiment includes a plurality of support brackets 126 and 126*a* affixed to main frame 12. Each support bracket 126 and 126*a* is associated with a particular bore, 56*a* and 58*a* respectively. The support brackets support the offset blanket cylinders, but similar brackets could be used for supporting other cylinders. In the case illustrated, support bracket 126 supports blanket cylinder 48*a*. In the embodiment illustrated, the external support means includes external support brackets 130 for supporting a portion of blanket cylinder shaft 52 which extends through bore 58*a*. Support brackets 126 and 130 as well as other support brackets include a support ring 134 and a flange 136 affixed to support ring 134. Bolts 138 secure the support brackets to main frame 12 through flange 136, and strength members 140 extend between support rings 134 and flanges 136 to give added strength to support rings 134 for supporting the cylinders.

A plurality of pilots 142 are affixed to the support brackets. As an example, pilot 142 affixed to support bracket 126 is used to position bracket 126 with respect to its bore 58*a*. In order to install blanket cylinder 48*a*, a combination of support bracket 126 and pilot 142 is positioned on shaft 52 of blanket cylinder 48*a* on at least one end of the shaft, in this case the end nearest to bore 58*a*. Blanket cylinder 48*a* is then positioned within frame 12 in close proximity to a position for respective rolling contact with the plates on plate cylinder 46*a* and an impression cylinder 146. Support bracket 126 is then installed using pilot 142 to locate the bracket with respect to bore 58*a*. Preferably, the bracket is preassembled on the cylinder shaft so that the entire assembly is simply dropped into place. The pilots will make enough contact with the original bores to accurately located the pilots and hence the support brackets and cylinders. If it is necessary to provide additional room for cylinder shafts 52 and their associated eccentric sleeves, then rough bores 144 and 144*a* can be provided adjacent to the original bores 56*a* and 58*a* respectively, but since the rough bores do not have to be the same diameter as the original bores, and in fact can be much smaller since they only have to accommodate the additional room needed by the eccentric sleeves and do not have to accommodate the bearings and other mechanisms, pilots 142 can make a precision fit with much of the original bores.

Shaft 148 of common impression cylinder 146 is supported by means 150 and 156 for rotatably supporting a shaft. Pre-existing means 152 supports outer end of shaft 148.

Gear train 158 in this embodiment allows blanket cylinders 48 and 48*a* to be driven from spur gear 38 by the common impression cylinder 146. Main frame 12 is bored so that shaft 148 extends all the way through main frame 12, supporting gear 38 and thus replacing a gear supporting shaft which was at location 132. In such an arrangement, common impression cylinder 146 is driven through gear 38. Plate cylinders 46 and 46*a* are driven on the operating side by their respective blanket cylinders.

Through such an arrangement, a web can be wrapped around common impression cylinder 146 for applying multicolor images to one side of the web. By the use of the eccentric sleeves in an arrangement with a half deck, blanket cylinders 48 and 48*a* can be moved into a blanket-to-blanket mode of operation for applying inked images to opposite side of a web fed between them.

Figure 8:
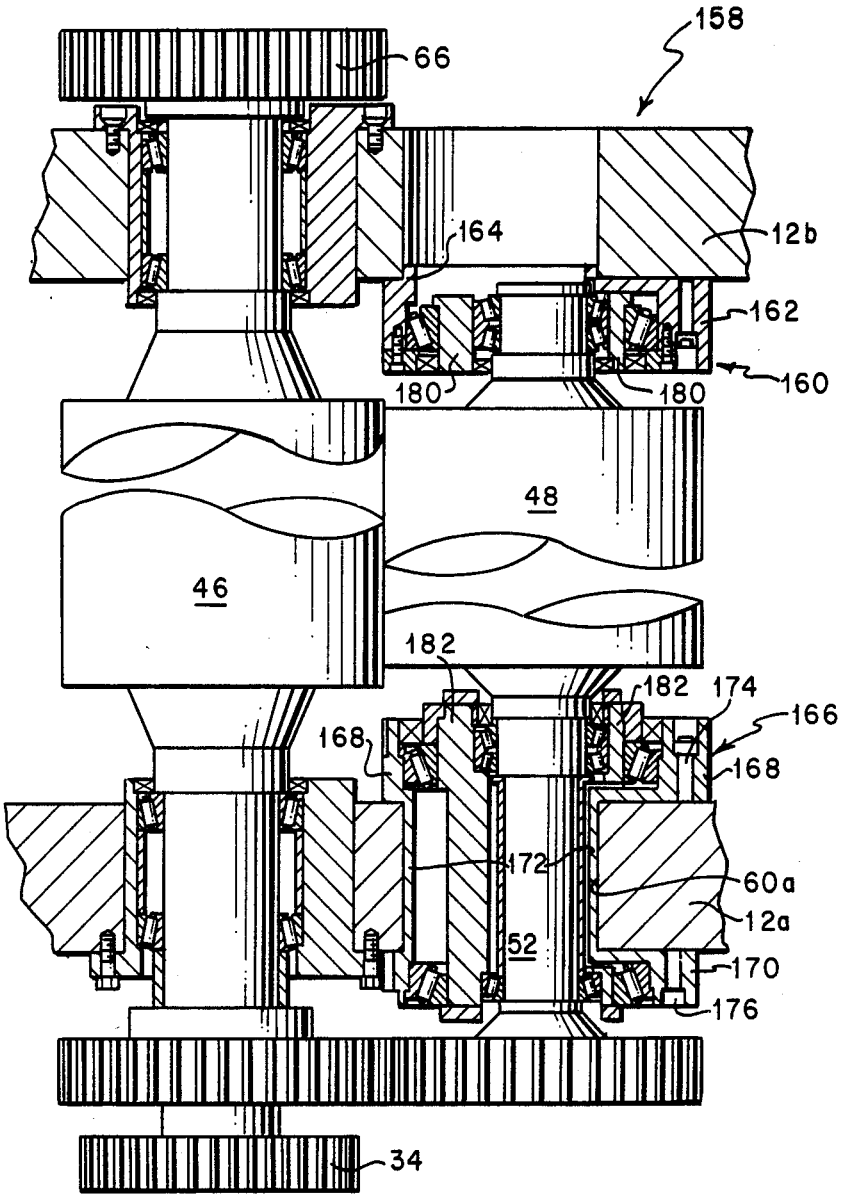
FIG. 8 is a detail of a view similar to the view of FIG. 4 of an alternative embodiment.
Figure 9:
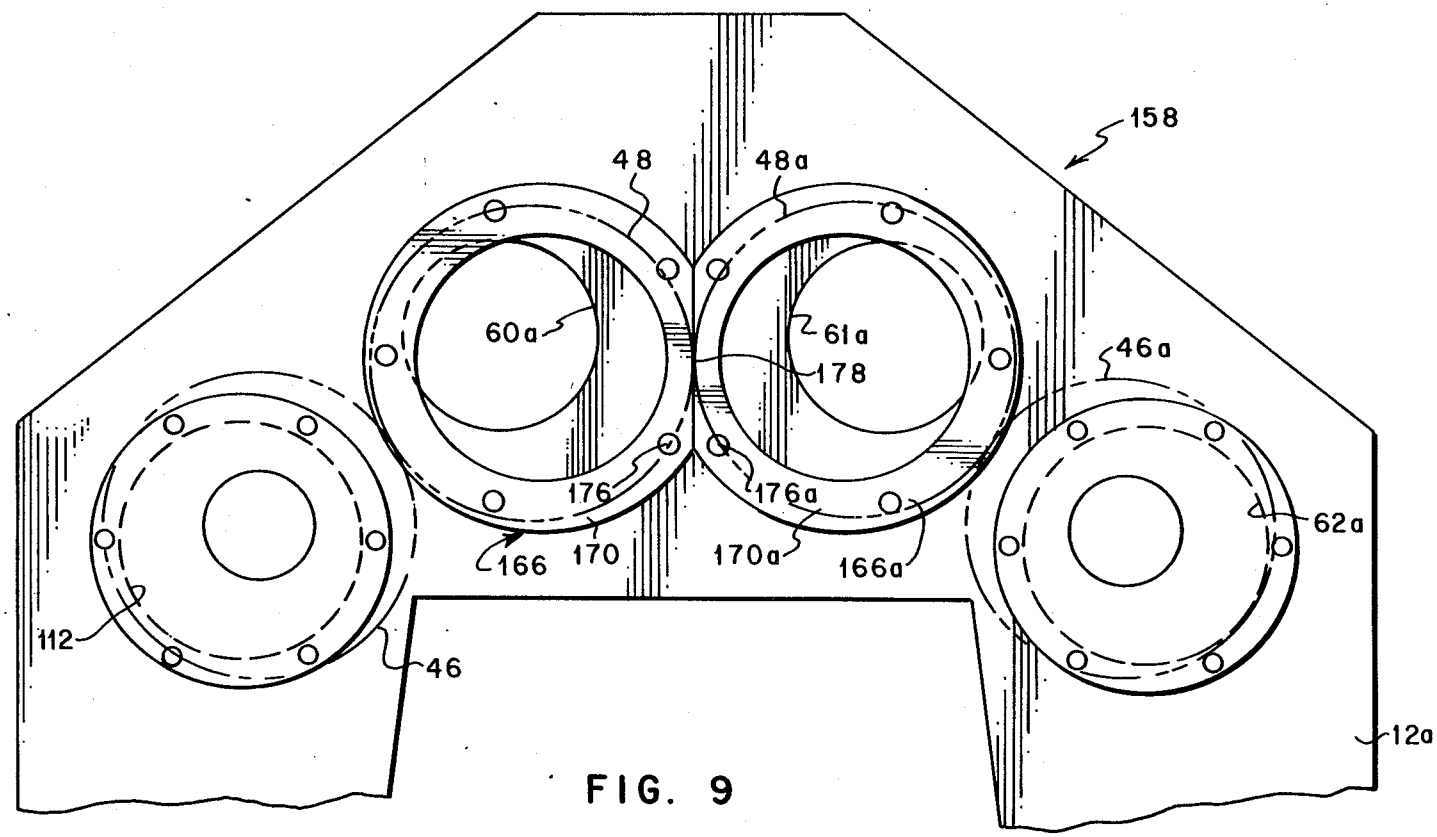
FIG. 9 is a view similar to that of FIG. 3, but with the cylinders shown in phantom.

Referring now to FIG. 8 and FIG. 9, a preferred embodiment of the present invention is referred to generally by reference numeral 158. A support bracket 160 consisting of a support ring 162 and a pilot 164, which is similar to the support brackets shown in the previous embodiment, acts as an internal support means for the operating end of blanket cylinder 48.

Figure 10:
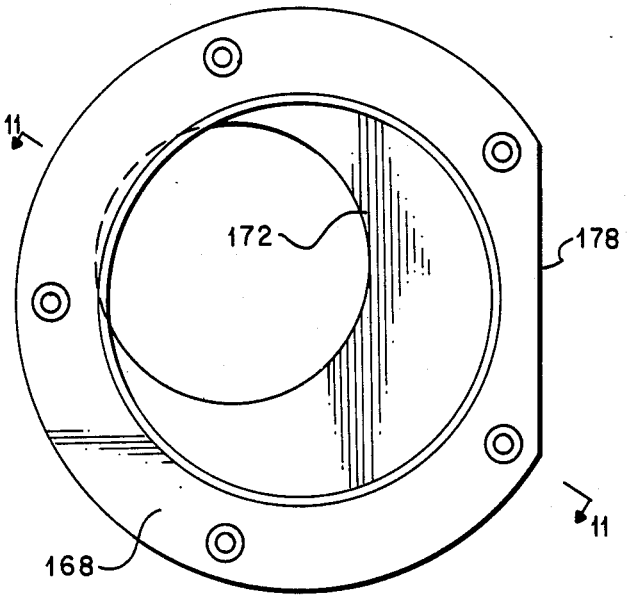
FIG. 10 is an enlarged view similar to that of FIG. 9 of a means for rotatably supporting offset cylinders shown in FIG. 8 and FIG. 9.
Figure 11:
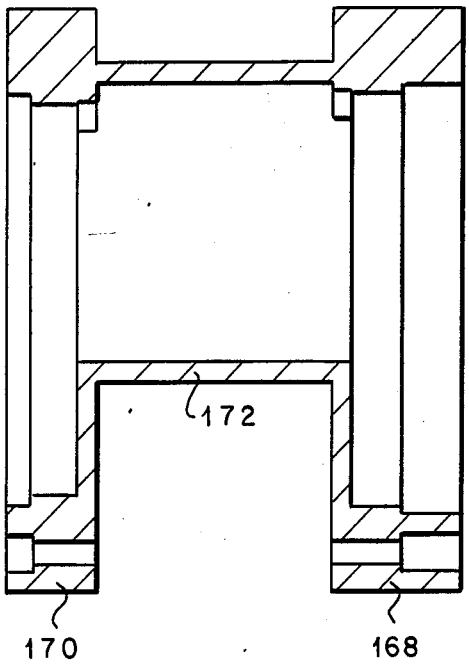
FIG. 11 is a cross-sectional view taken along line 11—11 in FIG. 10.

Referring also to FIG. 10 and FIG. 11, a support assembly 166 includes internal support ring 168, external support ring 170 and pilot 172 which also acts as means for rigidly connecting internal support ring 168 to external support ring 170. Pilot 172 thus acts as means for rigidly connecting the external support bracket to the internal support bracket and locating the brackets with respect to the bore. Shaft 52 of blanket cylinder 48 and pilot 172 extend through bore 60*a* when support assembly 166 is installed. Support assembly 166 is held in place by internal bolts 174 and external bolts 176. The addition of shims between internal support ring 168 and frame 12*a* or between external support ring 170 and frame 12*a* on installation may be necessary to achieve a tight fit.

Referring in particular to FIG. 9, a support assembly 166*a* similar to support assembly 166 is installed to support blanket cylinder 48*a*. Support rings 170 and 170*a* are designed to be large enough to form an interface 178 to aid in correctly positioning the two support assemblies.

Figure 12:
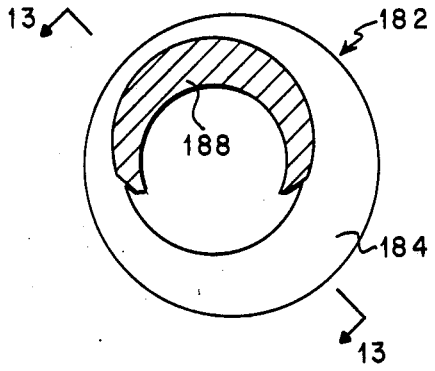
FIG. 12 is a cross-sectional view of a sleeve according to the present invention for use with the means for rotatably supporting an offset cylinder shown in FIG. 10 and FIG. 11.
Figure 13:
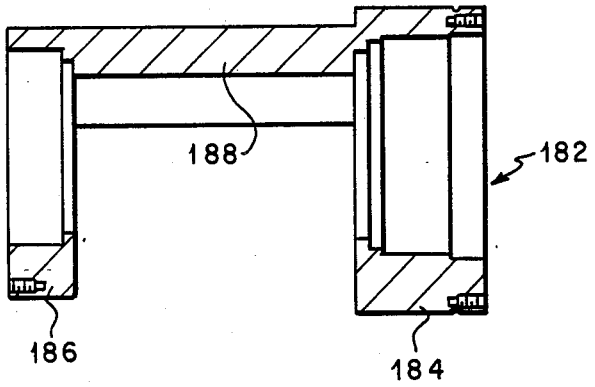
FIG. 13 is a cross-sectional view taken along line 13—13 in FIG. 12.

Referring also to FIG. 12 and FIG. 13, means for bodily swinging blanket cyinder 148 through a short radius arc includes eccentric sleeve 180 rotatably supported by support bracket 160 on the operating side and pass through eccentric sleeve 182 which is part of support assembly 166, rotatably supported by support rings 168 and 170. Pass through eccentric sleeve 182 comprises an internal eccentric sleeve 184, rotatably supported by internal support sleeve 168, an external eccentric sleeve 186 rotatably supported by external support ring 170 and means 188 for rigidly affixing internal eccentric sleeve 184 to external eccentric sleeve 186. Means 188 in a preferred arrangement does not connect the entire peripheries of internal eccentric sleeve 184 and external eccentric sleeve 186, thereby reducing the required size of bore 60*a*.

Since internal support ring 168 is rigidly connected to external support ring 170 and pass through eccentric sleeve 182 is entirely supported by the support rings, support assembly 166, in a preferred method, is completely assembled on the cylinder shaft prior to installation.

Turning now to FIGS. 14 through 22, there is shown a modified arrangement incorporating the principles of the present invention. As in the earlier embodiments, a letterpress unit is converted to offset printing through relocation of the printing cylinders. The printing cylinders include shafts which pass through bores in the main frame. In this manner, the advantages of positioning the offset drive gear train externally of the main frame are incorporated into the converted press unit.

The conversion to offset printing includes provision of internal and external support means affixed to the main frame for rotatably supporting offset cylinders with bearings inside and outside the main frame. In this embodiment an internal support means is associated only with one main frame wall and an external support means is associated only with the other main frame wall. With this arrangement the printing cylinders supported upon the internal and external support means are supported inside the main frame only adjacent one main frame wall and outside the main frame only adjacent the other main frame wall.

Referring now to FIGS. 14 through 22, a web fed offset printing press unit converted from web fed letterpress unit 10 of FIGS. 1 and 2 is referred to generally by reference numeral 442. It includes main frame 12 such as the frame of FIGS. 1 and 2 comprising main frame wall 12*a* and main frame wall 12*b*. Ink transfer rollers and drums 16 and 16*a*, and form rollers 18, 18*a*, 20 and 20*a* as well as dampening mechanism 64 and 64*a* are added to provide the offset plate inking function. Press unit 442 also includes driving mechanism through vertical power input shaft 26, pinion gear 40, spiral bevel gear 38.

The main frame 12 in this embodiment is not of the capped type illustrated in the embodiment of FIG. 7. In this embodiment each main frame wall 12*a* and 12*b* is an integral casting. These walls were originally provided with bores which were adapted to receive bearings supported upon eccentric sleeves which rotatably received and retained the printing cylinders in the letterpress configuration, such as in the arrangement of FIGS. 1 and 2. It must be appreciated, however, that the inventive arrangement of this embodiment is equally suitable to a letterpress main frame that is capped, i.e., that has removable caps which separate from the main frame along a parting line passing through the cylinder receiving bores. Such a frame is illustrated in FIG. 7.

Figure 16:
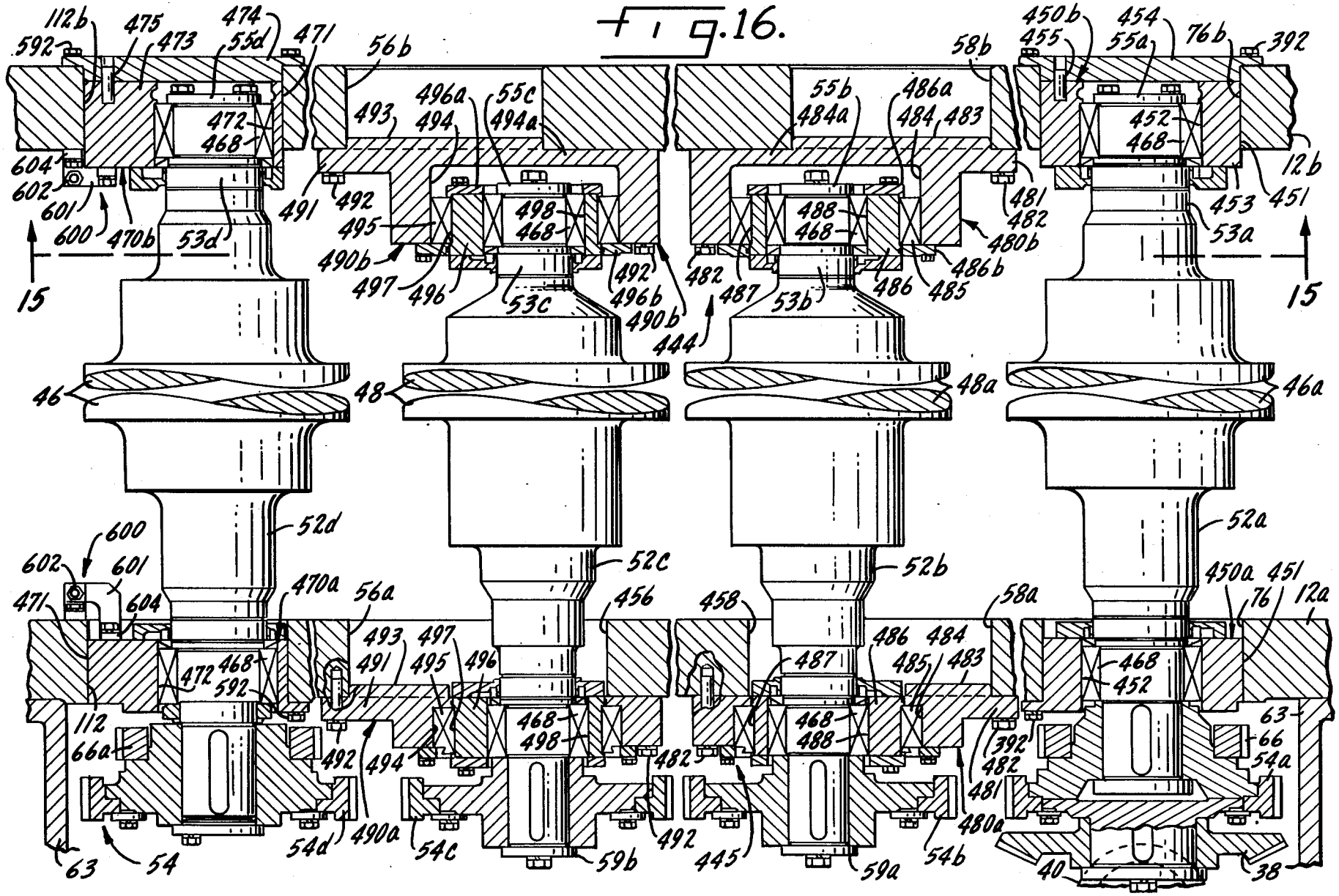
FIG. 16 is a top view, partially in section, of the press unit of FIG. 14 taken generally along the line 16—16 of FIG. 14 and spread for clarity.
Figure 22:
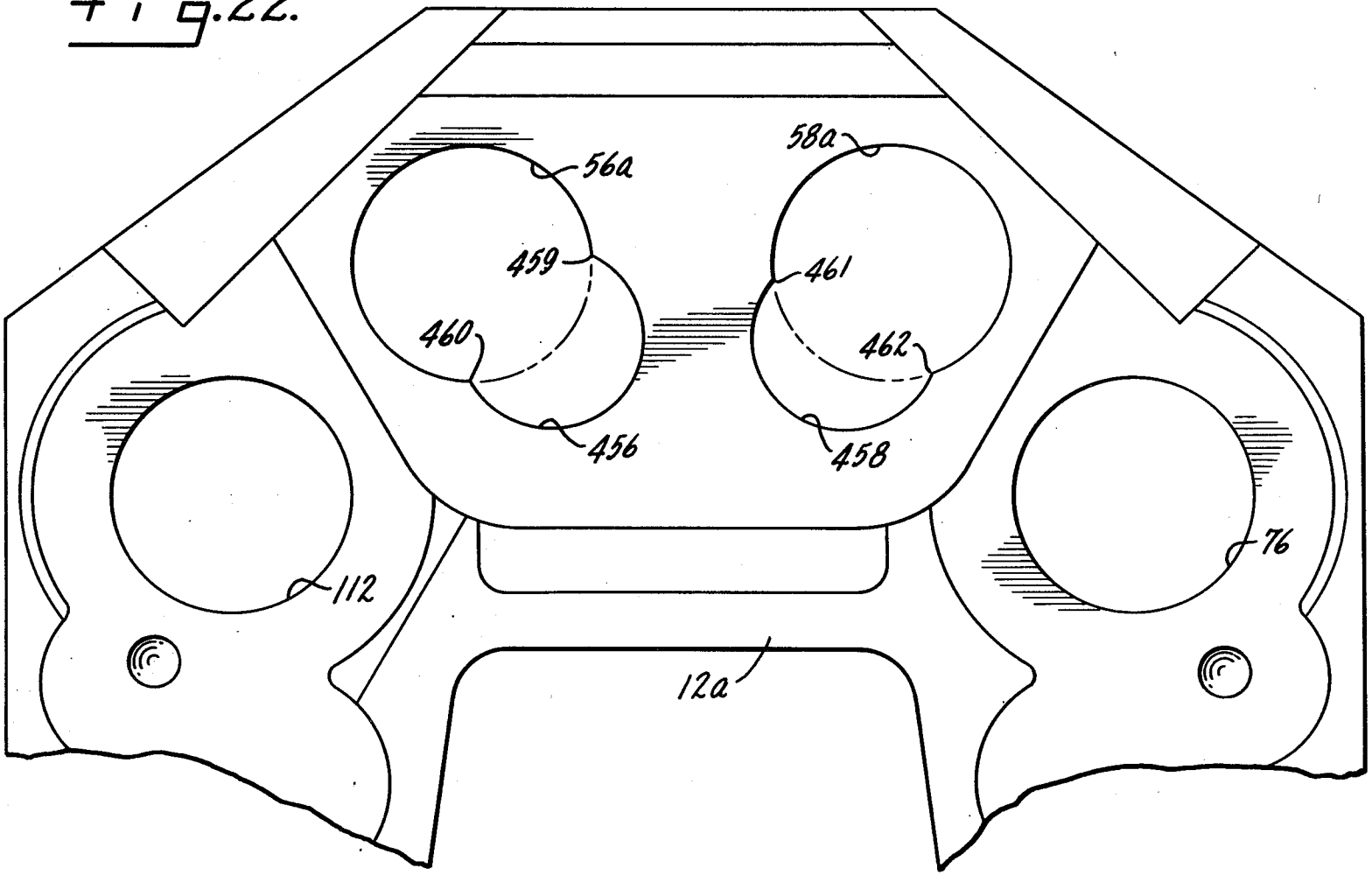
FIG. 22 is a view similar to FIG. 14 with cylinders, gears and associated equipment removed, illustrating the drive side main frame wall of the press unit of the embodiment of FIGS. 14–22.

FIG. 22 is illustrative of the main frame wall 12*a*. It includes bores 76, and 112 adapted to receive letterpress plate cylinders in a letterpress printing position and bores 56*a* and 58*a* adapted to receive letterpress impression cylinders in a letterpress printing position. Main frame wall 12*b*, as best seen in FIG. 16, is provided with similar bores, 76*b*, 112*b*, to support letterpress plate cylinders, and 56*b*, 58*b*, to support letterpress impression cylinders. The bores in wall 12*b* are in general coaxial alignment with the counterpart bores in frame wall 12*a*.

The converted press unit 442 includes a pair of offset plate cylinders 46, 46*a*, and a pair of offset blanket cylnders 48, 48*a* disposed for offset printing. As in the prior embodiments, and as will be more fully explained, certain of these cylinders are displaced from the position of the letterpress cylinders they replace in order to achieve the conversion of the present invention.

Rotatable support of cylinders 46, 46*a*, 48 and 48*a* is provided by shafts 52*a*, 52*b*, 52*c*, and 52*d* which extend outside the main frame through bores in main frame wall 12*a*, and shafts 53*a*, 53*b*, 53*c*, and 53*d* at the opposite ends of the cylinders. The position of offset plate cylinders 46 and 46*a* as compared to former letterpress plate cylinders is such that shafts 52*a* and 52*d* extend through existing bores 112 and 76 in main frame wall 12*a*. The displacement necessary to dispose blanket cylinders 48 and 48*a* for offset operation is of a magnitude that shafts 52*b* and 52*c* do not pass through existing bores 58*a* and 56*a*. To provide adequate clearance, new clearance bores 456 and 458, illustrated in FIG. 22, are cut in main frame wall 12*a* to permit passage of shafts 52*b* and 52*c* when the blanket cylinders are disposed in the offset printing position.

Since the bores 456 and 458 are clearance holes, no particular care is necessary in locating or forming the bore so long as clearance for shafts 52*b* and 52*c* is provided. They may be rough but, for example, with the main frame in situ using portable boring equipment.

It should be noted that bores 456 and 458 are only partially cylindrical since they overlap existing bores 56*a* and 58*a*. For example, bore 456 breaks into bore 56*a* at points 459 and 460 and forms an elongated opening. Bore 458 breaks into bore 58*a* at points 461 and 462 and forms an elongated opening. These points are illustrated in FIG. 22.

Figure 14:
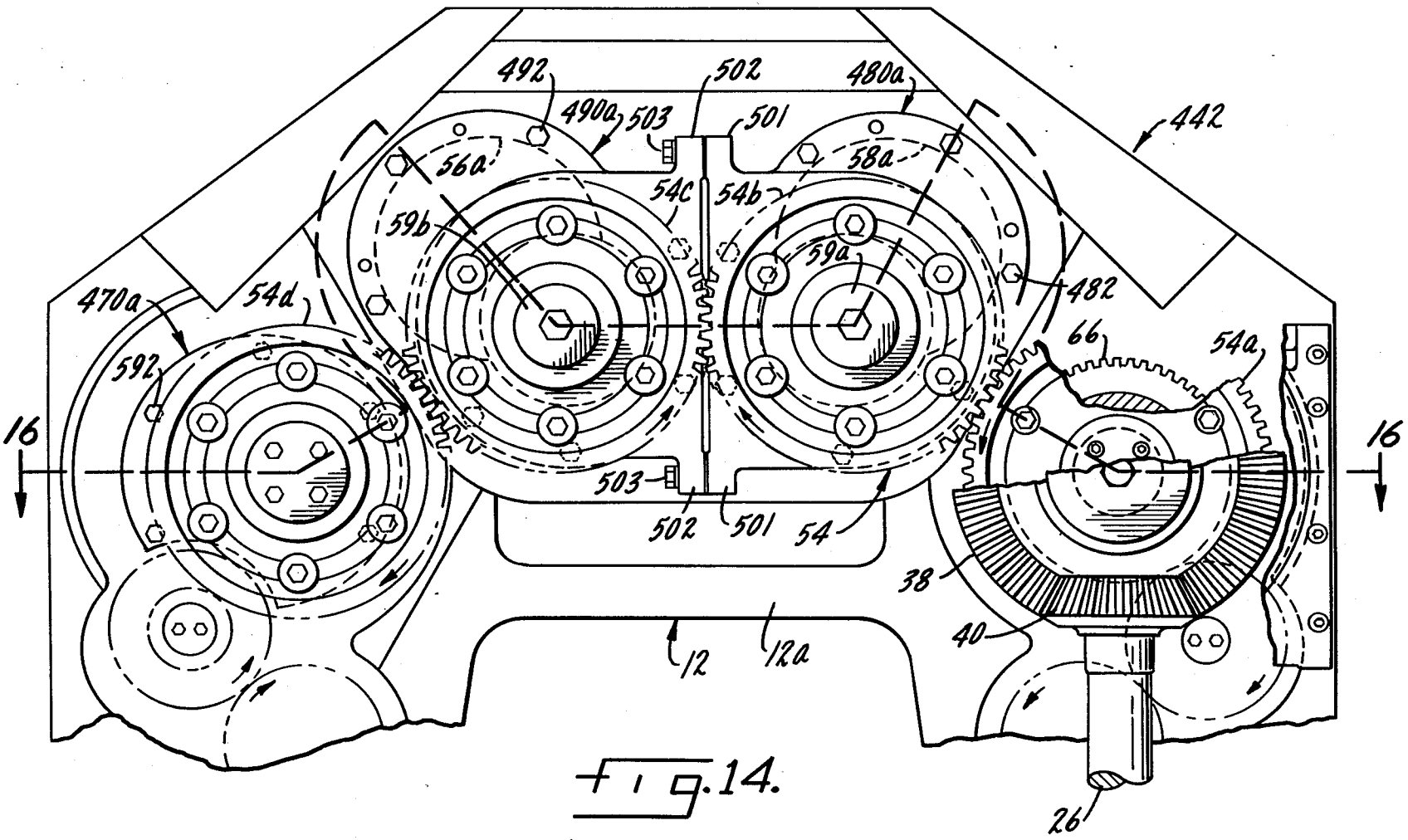
FIG. 14 is a fragmentary plan view of a press unit illustrating a modified form of the invention showing the drive side end of the cylinders.

Consistent with the objective of this embodiment and as best seen in FIGS. 14 and 16, drive gear train 54 is disposed outside the main frame, in that it is disposed exteriorly to main frame wall 12*a*. Preferably gear train 54 is encased in an oil tight housing 63 partially illustrated in FIG. 16. It should also be noted that the gears of gear train 54 are actually in mesh. They are illustrated in spaced relation in FIG. 16 because of the expanded nature of that view which was intended to permit full illustration of all elements of the embodiment.

Drive gear train 54 includes helical gear 54*a* secured to plate cylinder shaft 52*a*. Gear 54*a* is connected to, and driven by, spiral bevel gear 38 which receives power from pinion gear 40 on power input shaft 26. Gear 54*a*, in turn, drives blanket cylinder helical gear 54*a* secured to shaft extension 52*b* of cylinder 48*a*. Gear 54*b* drives the other blanket cylinder helical gear 54*c* secured to shaft extension 52*c* of blanket cylinder 48. Gear 54*c*, in turn, drives the other plate cylinder helical gear 54*d* which is secured to extension 52*d* of plate cylinder 46.

With this arrangement, the gear train is not disposed intermediate the main frame walls 12*a* and 12*b* but rather exterior to frame wall 12*a*. This minimizes the sacrifice of space between the main frame walls necessary for conversion and maximizes permissible printing cylinder width, and consequently web width.

Gears 66 and 66*a* are provided on plate cylinder shafts 52*a* and 52*d*. These gears provide necessary driving input to the ink system such as form rollers 18, 20, 18*a* and 20*a* in a well known manner.

In accordance with the principles of the invention, positioning of the printing cylinders in the offset perfecting array is accomplished through interposition of internal support means generally designated 444 and external support means generally designated 445 which rotatably support certain of the cylinders in the relocated position. In this embodiment blanket cylinders 48, 48*a* are rotatably supported upon the internal and external support means 444 and 445. The position of original bores 76, 76*b*, 112, 112*b* in the main frame are such that they may be utilized in connection with support of the plate cylinders 46 and 46*a* directly upon the main frame 12.

Significant to this embodiment is the presence of internal support means 444 at only one wall 12*b* of main frame 12 and external support means 445 at only the other wall 12*a*. With this arrangement, rotatable support is provided for the plate cylinders 46, 46*a* and for the blanket cylinders 48, 48*a* at essentially the same axial spacing along the respective cylinders as existed in the letterpress configuration. Further, the bearing support of the shafts 52*a*, 52*b*, 52*c*, 52*d* connected to gear train 54 is relatively close to the gears, as compared, for example, to such bearing support as might be located inside the main frame wall 12*a*. This, therefore, reduces overhang and minimizes possible flexture problems which could affect print quality.

In this embodiment the location of offset plate cylinder 46*a*, which receives input power directly from vertical power input shaft 26, is located in the same location as was the former corresponding letterpress plate cylinder. Cylinder 46*a* is rotatably supported within the bores 76, 76*b* of main frame walls 12*a* and 12*b* upon bearing housings 450*a* and 450*b*.

Each bearing housing 450*a*, 450*b* includes an outer cylindrical surface 451 received in one of the bores 76, 76*b*. These bearing housings are secured against rotation by bolts 392 which connect them to the associated main frame walls 12*a*, 12*b*. Each housing further includes a generally cylindrical bore 452 concentric with the axis of bores 76, 76*b* in which are received bearings 468.

Bearings 468 are in the form of roller bearing sets having inner and outer races and interposed rollers. The outer races are received within the bores 452 and the inner races are connected to cylinder shafts 52*a* and 53*a* and rotatably support cylinder 46*a* upon main frame 12 through housings 450*a* and 450*b*. Though, in the illustrated embodiment, roller bearings are utilized, it must be appreciated that any suitable bearings, such as ball bearings or the like, may be used without departing from the scope of the invention.

The conversion accomplished in this embodiment requires shifting of the longitudinal axis of offset plate cylinder 46 in a direction toward the plate cylinder 46*a*. The longitudinal axis of plate cylinder 46 is, therefore, displaced from the axis of bores 112, 112*b*, but not to the extent that support upon internal or external support means is required. It should be appreciated, however, that should the required displacement be such that the plate cylinder could not be supported in the main frame bores 112, 112*b*, it is contemplated that internal support means 444 and external support means 445 would include means to support plate cylinder 46. It is also contemplated that original bore 112 would be enlarged by a clearance bore to permit passage of shaft 52*d* to the exterior of wall 12*a*.

Plate cylinder 46 is supported in bores 112, 112*b* upon eccentric bearing housings 470*a*, 470*b*. Each includes an outer cylindrical surface 471 received in a bore 112, 112*b*, and is also provided with a bore 472 formed eccentric to the outer cylindrical surface 471.

Figure 15:
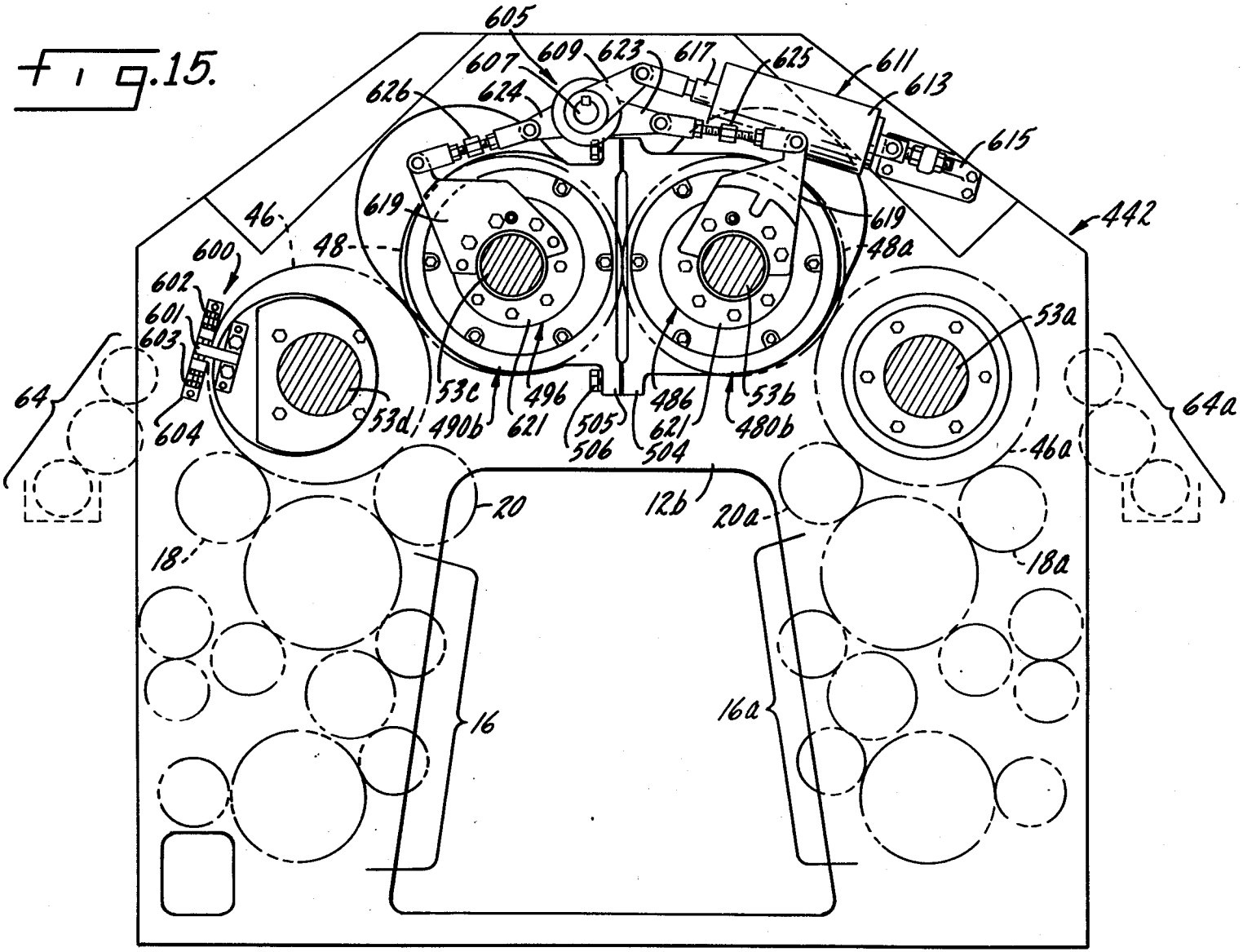
FIG. 15 is a sectional elevational view of the press unit of FIG. 14 taken generally along the line 15—15 of FIG. 16.

These eccentric bearing housings are secured against rotation by bolts 592 which connect them to main frame wall 12*a* and 12*b*. As best seen in FIG. 15, each is provided with a rotation adjustment lock 600 which includes a lever arm 601 attached to the eccentric housing and a pair of adjustment bolts 602, 603 threaded into brackets 604, which are attached to main frame walls 12*a*, 12*b*.

Each eccentrically positioned bore 472 receives a bearing set 468 which, in turn, supports shafts 52*d* and 53*d* of cylinder 46. As in the case of the plate cylinder 46*a*, bearings 468 are roller bearing sets, but any other suitable form of bearing could be used. The outer races are received within bores 472 and the inner races are connected to shafts 52*d* and 53*d*. The interposed rollers provide rotatable support for the plate cylinder 46.

The eccentric location of bores 472 with respect to outer cylindrical surfaces 471 of eccentric housings 470*a*, 470*b*, permits slight adjustment of the plate cylinder 46 toward and away from plate cylinder 46*a* to achieve proper cylinder positioning. Bolts 592 are loosened, and adjustment bolts 602 and 603 are rotated to radially position lever arm 601. This rotates housings 470*a* and 470*b*, within bores 112, 112*b*, and moves eccentrically formed bores 472 about the axis of bores 112, 112*b* toward or away from cylinder 46*a*. When proper location is achieved, bolts 602, 603 and 592 are tightened to lock cylinder 46 in position.

In accordance with the present invention blanket cylinders 48, 48*a* are supported upon internal support means 444 interiorly of main frame wall 12*b* and external support means 445 exteriorly of main frame wall 12*a*. Internal support means 444 is comprised of a pair of non-rotatable brackets 480*b*, 490*b*, associated with existing bores 58*b*, 56*b* and secured to the interior of main frame wall 12*b*. External support means 445 is comprised of a pair of nonrotatable brackets 480*a*, 490*a*, associated with existing bores 56*a*, 58*a*, and secured to the exterior of main frame wall 12*a*. They are illustrated on a slightly enlarged scale in FIGS. 18–21. For added strength and stability, the brackets 480*a*, 490*a* of external support means 445 are bolted together at flanges 501, 502 by bolts 503. Similarly, brackets 480*b*, 490*b* are bolted together at contacting flanges 504, 505 by bolts 506. This connection between the separate brackets is considered optional, but is illustrated as a way to add to the total strength of the support means and resist any rotational forces imparted during operation. It in addition aids in maintaining alignment of the brackets after assembly.

Blanket cylinder 48*a* is supported at one end, the gear drive end, by external support bracket 480*a* of external support means 445. It is supported at the opposite end, by internal support bracket 480*b* of internal support means 444. Bracket 480*a* (FIGS. 19, 19*a*) and bracket 480*b* (21, 21*a*) include flanges 481 secured respectively to wall 12*a* and 12*b* by bolts 482. Each includes a pilot 483 having a generally cylinder exterior surface which is disposed within one of the original bores 58*a*, 58*b* in main frame 12. This engagement between the pilots 483 and the bores 58*a*, 58*b* serves to locate brackets 480*a*, 480*b* in proper position to support the blanket cylinder 48*a* for offset printing.

It should be noted that pilot 483 of bracket 480*b* is completely cylindrical and mates with bore 58*b* about its entire periphery. However, because shaft 52*b* must pass through bracket 480*a*, and because bore 58*a* has been elongated by virtue of clearance bore 458, the cylindrical extent of pilot 483 of bracket 480*a* engages bore 58*a* only between points 461 and 462. This is, however, sufficient to accomplish necessary location of bracket 480*a*.

Figure 19:
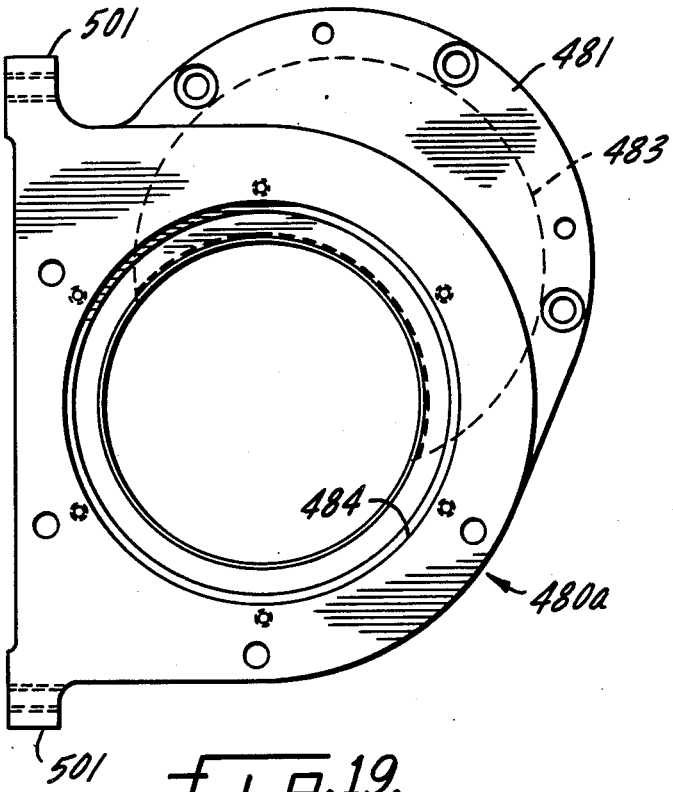
Figure 19A:
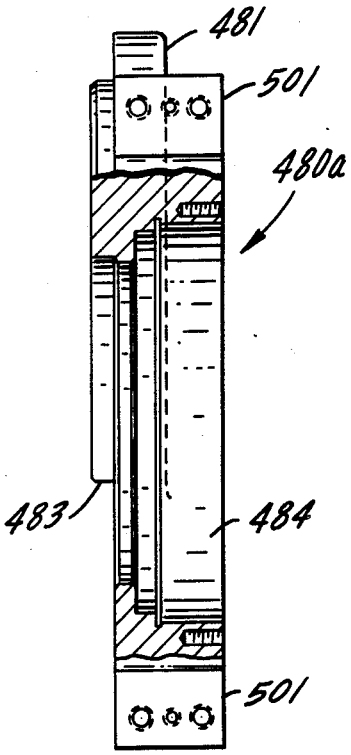
Figure 20:
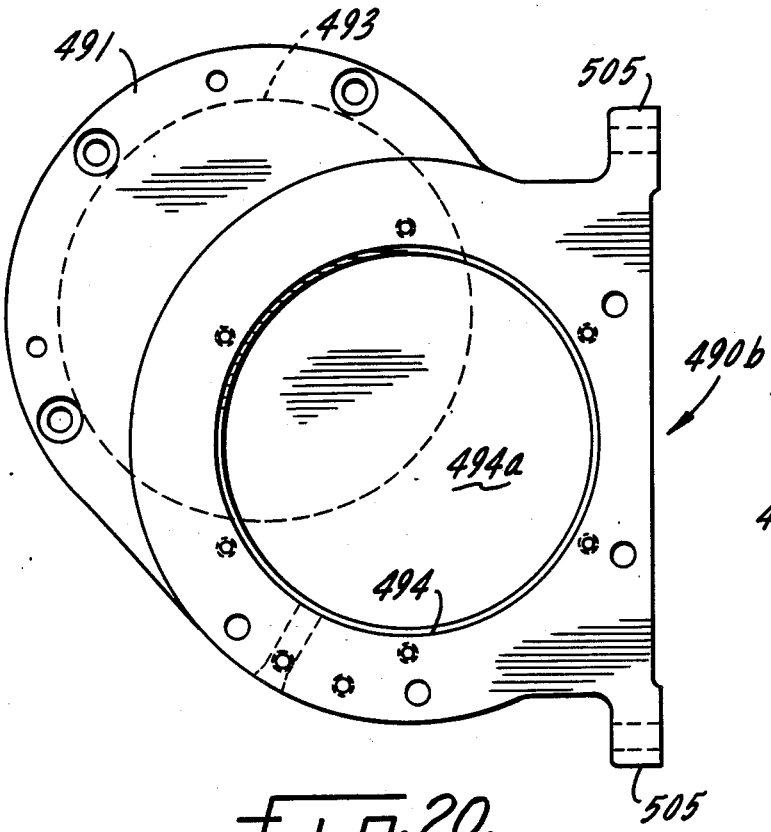
FIGS. 20, 20*a*, 21, and 21*a* are slightly enlarged front and side views, partially in section, of a portion of the housing apparatus illustrated in FIG. 15.
Figure 20A:
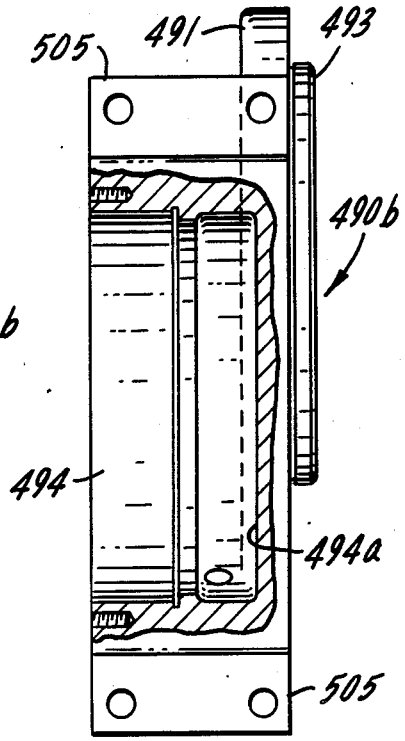
Figure 21:
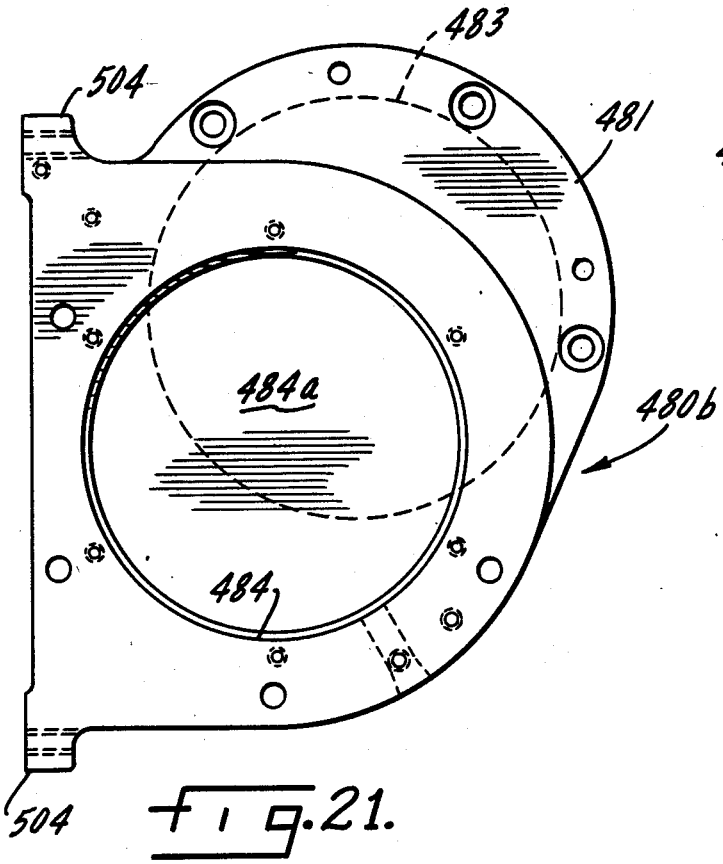
Figure 21A:
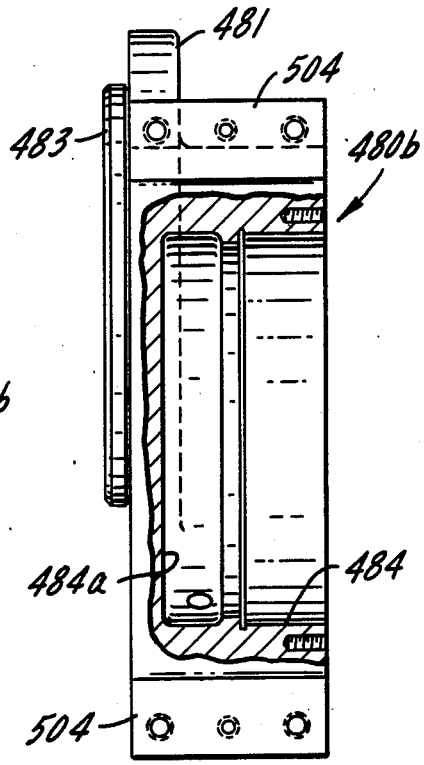

Each bracket 480*a*, 480*b* defines a throw-off receiving bore 484. Bore 484 of bracket 480*b* is disposed inside the main frame. Bore 484 of bracket 480*a* is disposed outside the main frame in that it is exterior to wall 12*a*. Bores 484 are axially aligned with each other but are eccentrically positioned with respect to the axis of associated aligned bores 58*a*, 58*b* of main frame 12. They are displaced from bores 58*a*, 58*b* to be in proper location for supporting cylinder 48*a* for offset printing. The bore 484 in bracket 480*b* is not entirely through the bracket, but rather terminates in web 484*a* adjacent pilot 483. Since bracket 480*a* must pass shaft 52*b*, bore 484 of that bracket is a through bore. As seen in FIGS. 19, 19*a*, the through bore cuts away a portion of pilot 483 generally at the same location that clearance bore 458 cuts away from frame 12*a* between points 461 and 462.

Within each such bore 484 is a throw-off bearing 485 in the form of a ball or roller bearing set. The inner race of each bearing supports a throw-off housing 486 having a generally cylindrical exterior surface 487 and an internal eccentrically disposed bore 488.

Shaft supporting bearings 468 in the form of roller bearing sets are disposed in eccentrically formed bores 488. Bearings 468 include outer races secured within eccentrically disposed bores 488 and inner races affixed to shafts 52*b* and 53*b* of blanket cylinder 48*a*. Cylinder 48*a* is thus rotatably supported upon internal bracket 480*b* of support means 444 adjacent main frame wall 12*b* and upon external bracket 480*a* of external support means 445 adjacent main frame wall 12*a*. Bracket 480*b* is inside the main frame in the context that it is disposed between main frame walls 12*a* and 12*b*. External bracket 480*a* is outside the main frame in that it is secured to the exterior of one of the walls, wall 12*a*. The bearings 468 are located exterior to the plane of walls 12*a* and 12*b*.

Blanket cylinder 48 is supported at one end, the gear drive end, by external support bracket 490*a* of external support means 445. It is supported at the opposite end by internal support bracket 490*b* of internal support means 444. Bracket 490*a* (FIGS. 18, 18*a*) and bracket 490*b* (20, 20*a*) include flanges 491 secured respectively to wall 12*a* and 12*b* by bolts 492. Each includes a pilot 493 having a generally cylindrical exterior surface which is disposed within one of the original bores 56*a*, 56*b* in main frame 12. This engagement between the pilots 493 and the bores 56*a*, 56*b* serves to fix the brackets 490*a*, 490*b* with respect to the main frame walls in proper position for the converted press operation.

It should be noted that pilot 493 of bracket 490*b* is completely cylindrical and mates with bore 56*b* about its entire periphery. However, because shaft 52*c* must pass through bracket 490*a*, and because bore 56*a* has been elongated by virtue of clearance bore 468, the cylindrical extent of pilot 493 of bracket 490*a* engages bore 56*a* only between points 459 and 460. This is, however, sufficient to accomplish necessary location of bracket 490*a*.

Figure 18:
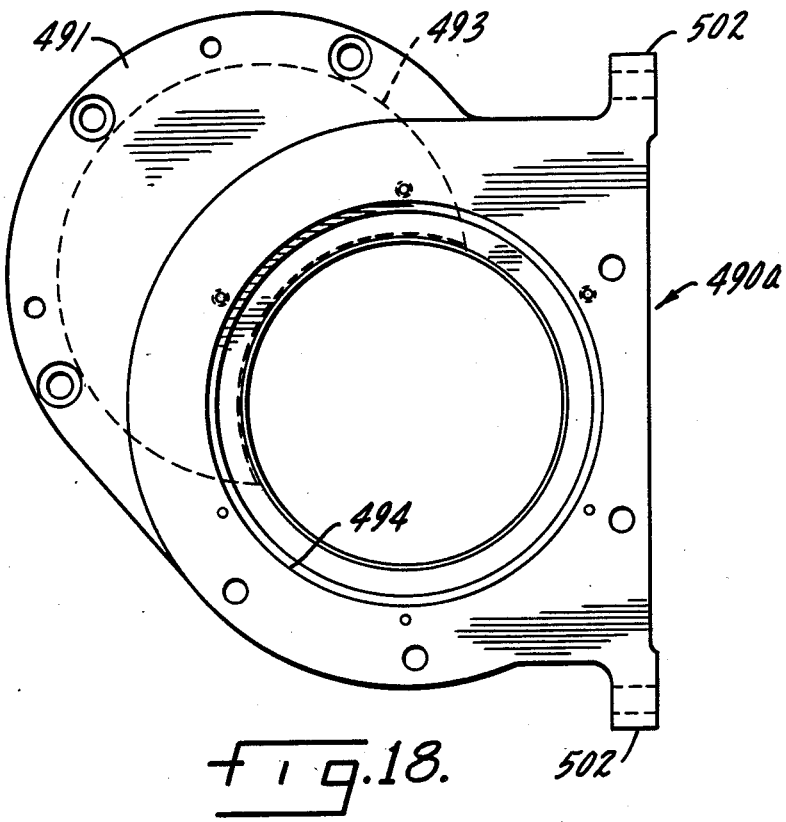
FIGS. 18, 18*a*, 19, and 19*a* are slightly enlarged front and side views, partially in section, of a portion of the housing apparatus illustrated in FIG. 14.
Figure 18A:
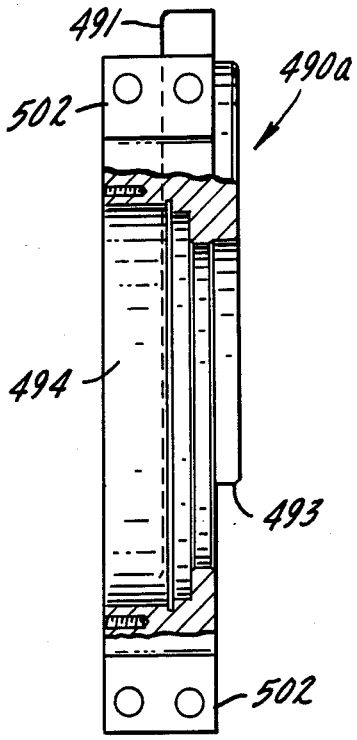

Each bracket 490*a*, 490*b* defines a throw-off receiving bore 494. Bore 494 of bracket 490*b* is disposed inside the main frame. Bore 494 of bracket 490*a* is disposed outside the main frame in that it is exterior to wall 12*a*. Bores 494 are axially aligned with each other but are eccentrically disposed with respect to the axis of associated aligned bores 56*a*, 56*b* of main frame 12. The bores are displaced from the bores 56*a*, 56*b* to be in proper location for supporting cylinder 48 for offset printing. The bore 494 in bracket 490*b* is not entirely through the bracket, but rather terminates in web 494*a* adjacent pilot 493. Since bracket 490*a* must pass shaft 52*c*, bore 494 of that bracket is a through bore. As seen in FIGS. 18, 18*a*, the through bore cuts away a portion of pilot 493 generally at the same location that clearance bore 456 cuts away frame 12*a* between points 459 and 460.

Within each such bore 494 is a throw-off bearing 495 in the form of a roller bearing set. Ball bearings could of course be used. The inner race of each bearing supports a throw-off housing 496 having a generally cylindrical exterior surface 497 and an internal eccentrically disposed bore 498.

Shaft supporting bearings 468 in the form of roller bearing sets are disposed in eccentrically disposed bores 498. Bearings 468 include outer races secured within eccentrically disposed bores 498 and inner races affixed to shafts 52*c* and 53*c* of blanket cylinder 48. Cylinder 48 is thus rotatably supported upon internal bracket 490*b* of support means 444 adjacent main frame wall 12*b* and upon external bracket 490*a* of external support means 445 adjacent main frame wall 12*a*. Bracket 490*b* is inside the main frame in the context that it is disposed between main frame walls 12*a* and 12*b*. External bracket 490*a* is outside the main frame in that it is secured to the exterior of one of the walls, wall 12*a*. The bearings 468 are located exterior to the plane of walls 12*a* and 12*b*.

Figure 17:
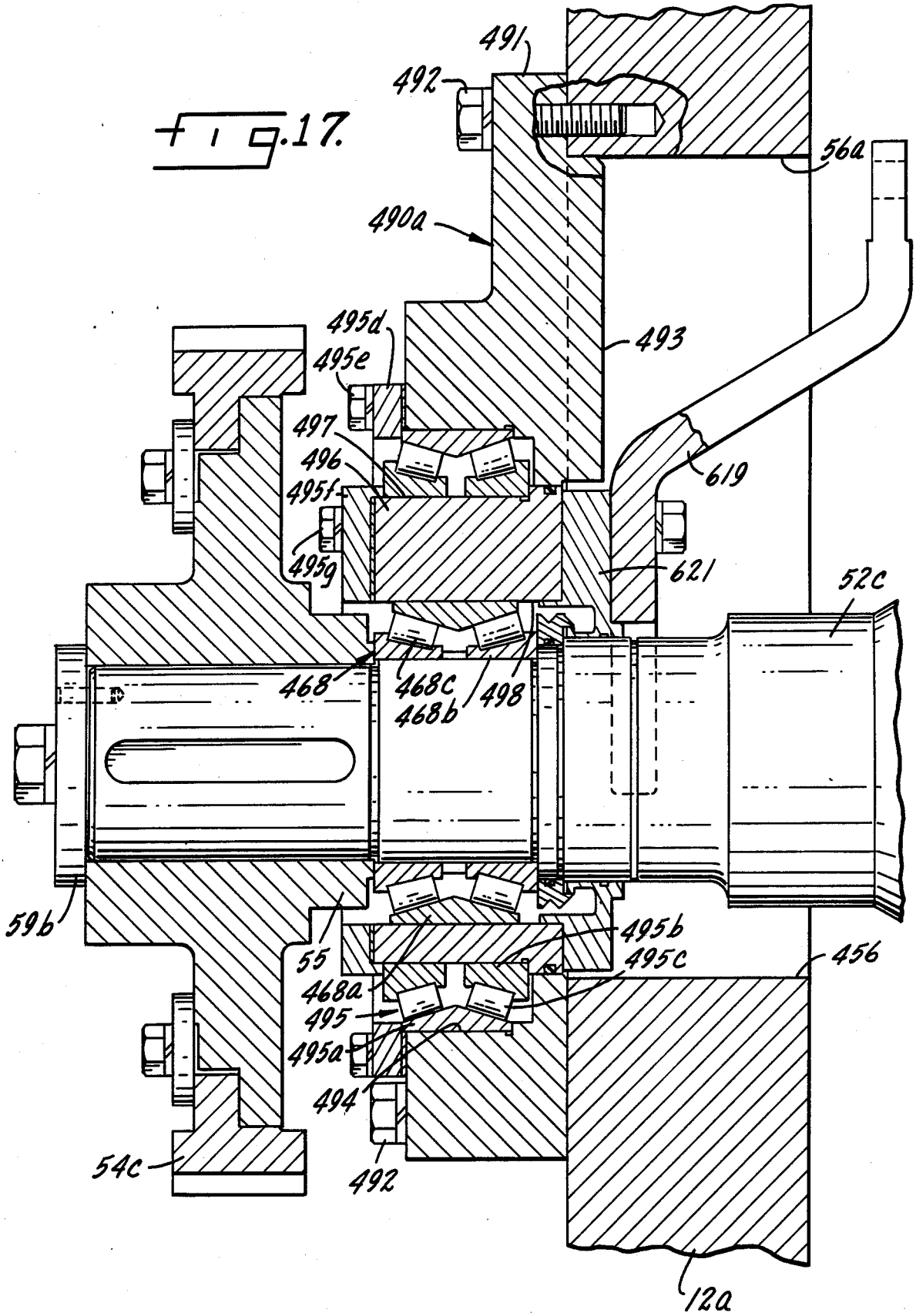
FIG. 17 is an enlarged fragmentary view of a portion of the apparatus illustrated in FIG. 16 showing typical details of the cylinder support means.

For illustration purposes, FIG. 17 depicts details of external support bracket 490*a*. The throw-off bearing 495, eecentric throw-off housing 496, and cylinder support bearing 468 are considered typical of the arrangements found in brackets 480*a*, 480*b*, 490*a* and 490*b*. The axial displacement of throw-off receiving bores 484 and 494 with respect to associated bores 58*a*, 58*b*, 56*a* and 56*b* is, however, dependent upon the location of the particular bracket. Precise distances and angles would, of course, vary depending on the original configuration of the press unit converted.

Bores 484, defined by brackets 480*a* and 480*b*, are displaced generally vertically downward and horizontally away from plate cylinder 46*a* as compared to original bores 58*a* and 58*b*. Bores 494 defined by brackets 490*a* and 490*b* are displaced generally vertically downward and toward plate cylinder 46*a* as compared to original bores 56*a* and 56*b*. The amount of such displacement is such that blanket cylinders 48 and 48*a* are disposed in proper positions for offset printing.

Referring to FIG. 17, external support bracket 490*a* is positioned with respect to main frame wall 12*a* by the engagement of semi-cylindrical pilot 493 with bore 56*a* Flange 491 of bracket 490*a* is secured to wall 12*a* by bolts 492.

Bracket 490*a* houses throw-off bearing 495 within throw-off receiving bore 494. Bearing 495 includes outer race 495*a* secured within bore 494, inner race 495*b* secured to throw-off housing 496 and rollers 495*c*. Outer race 495*a* is secured to bracket 490*a* by annular bolt ring 495*d* and bolts 495*e*. Inner race 495*b* is secured to throw-off housing 496 by annular bolt ring 495*f* and bolts 495*g*.

Shaft 52*c* of blanket cylinder 48 is rotatably supported within eccentrically formed bore 498 of throwoff housing 496 upon shaft supporting bearing 468. Bearing 468 includes outer race 468*a* pressed into bore 498, inner race 468*b* held on shaft 52*c* by hub 55 of gear 54*c*, and interposed roller bearings 468*c*. In operation shafts 52*c*, 53*c* and blanket cylinder 48 rotate upon bearings 468 disposed within housings 496 of internal and external support brackets 490*a* and 490*b*. Similarly, shafts 52*b* and 53*b* and blanket cylinder 48*a* rotate upon bearings 468 disposed within housings 486 of internal and external support brackets 480*a* and 480*b*.

As is conventional for offset printing, press unit 442 is provided with mechanism 605 illustrated in FIG. 15 to effect throw-off, and throw-on of blanket cylinders 48, 48*a*. In web fed offset printing it is necessary to move the cylinders from a position of line contact, to a position with clearance between cylinders to perform a variety of operations, such as installing plates on the plate cylinders 46, 46*a*, inserting the web between the blanket cylinders, clearing web breaks, and the like.

In the illustrated embodiment, mechanism 605 is adapted to revolve throw-off housings 486 and 496 to move blanket cylinders 48 and 48*a* between a printing position and a throw-off position. In the printing position each blanket cylinder contacts its associated plate cylinders 46, 46*a* and also contacts the other blanket cylinder for simultaneous printing on opposite sides of an interposed web. For example, in the throw-off position, each blanket cylinder48, 48*a* may be spaced approximately 0.040 to 0.060 inches from the other and 0.020 to 0.050 inches from associated plate cyinder 48 or 48*a*. Precise dimensions, however, may vary and are dependent on particular press configurations.

The portion of mechanism 605 associated with main frame wall 12*b* is illustrated in FIG. 15. A substantially identical arrangement, not shown, is provided at the interior surface of wall 12*a*.

Mechanism 605 includes actuator shaft 607 extending between main frame walls 12*a* and 12*b* and pivotally supported thereon. It includes a crank 609 affixed adjacent each end. The shaft is rotated simultaneously at each end by throw-off actuator cylinders 611.

Cylinders 611 each include a body 613 pivotally connected to a main frame wall 12*a* or 12*b* by brackets 615. Each further includes piston shaft 617, pivotally connected to cranks 609. Upon energization of cylinders 611, piston shafts 617 extend outwardly from bodies 613 and cause cranks 609 and consequently shaft 607 to rotate in one direction. De-energization causes piston shafts 617 to return to their original positions, which causes cranks 609 and shaft 607 to rotate in the opposite direction.

Each of throw-off housings 486 and 496 is provided with a throw-off lever 619 bolted to the radial surfaces 621 of the throw-off housings. As illustrated in FIG. 15, the portions of throw-off mechanism 605 associated with each main frame wall are inside the main frame in that they are disposed intermediate the frame walls. Throw-off housings 486 and 496 of external support means 445 are, however, disposed outside the main frame in that they are disposed exteriorly of wall 12*a*. For this reason, and as best seen in FIG. 17, cranks 619 connected to throw-off housings 486 and 496 of external support means 445 pass through the bores in main frame wall 12*a* and connect to radial surfaces 621 of the housings 486 and 496 which face toward the surfaces 621 illustrated in FIG. 15.

Actuator shaft 607 is provided with a pair of actuator cranks 623 and 624 adjacent each main frame wall. Pivotal links 625 connect cranks 623 with throw-off levers 619 connected to throw-off housings 486. Pivotal links 626 connect cranks 624 to throw-off levers 619 connected to throw-off housings 496.

Rotation of shaft 607 causes cranks 623 and 624 to rotate throw-off housings 486 and 496 upon throw-off bearings 485 and 495 through cranks 623, 624, links 625, 626, and throw-off levers 619. In this manner, throw-off and throw-on of blanket cylinders 48, 48*a* is accomplished by activation and deactivation of throw-off cylinders 611.

The conversion process from a letterpress printing unit, for example as illustrated in FIGS. 1 and 2, to an offset perfecting unit proceeds generally in accordance with previous embodiments. It includes removal of original letterpress plate cylinders 14 and 14*a* and letterpress impression cylinders 22 and 22*a*.

The letterpress ink system is replaced with offset ink supply system including ink drums and transfer rollers 16, 16*a*, form rollers 18, 18*a*, 20 and 20*a*. Offset dampening mechanisms 64 and 64*a* are also added. Though the sequence of this phase of conversion is not critical, the foregoing changes are normally either entirely or partially completed prior to assembly of offset printing cylinders to the main frame.

In instances such as illustrated in respect to the embodiment of FIGS. 14–22, main frame wall 12*a* must be provided with clearance bores 456 and 458. As previously indicated, these bores may be rough cut, since they are not required for location or positioning of components.

Assembly of printing cylinders 46, 46*a*, 48, 48*a* into press unit 442 may proceed in a variety of ways. However, since the illustrated frame is not capped, as would be the main frame of FIG. 7, the following description is considered typical of assembly of a press unit utilizing such frame. A capped frame on the other hand would permit substantial preassembly of components upon the cylinder shafts 52*a–d* and 53*a–d* since the cylinders may be lowered vertically into the main frame bores exposed by removal of the caps. This alternative is well within the contemplated scope of the present invention which is not dependent upon whether the main frame is capped or uncapped.

In the illustrated embodiment cylinders 46, 46*a*, 48, 48*a* are inserted into position between main frame walls 12*a* and 12*b* prior to placement of support elements 450*a*, 470*a*, 480*a*, and 490*a* or gears 54*a–d* onto shafts 52*a–d*. These elements are slid onto the shaft ends after positioning of the cylinders. This is accomplished from outside the main frame wall 12*a* as will be apparent.

Bearing housings 450*b* and 470*b* may first be positioned in bores 76*b* and 112*b*. Shafts 53*a* and 53*d* are provided with bearings 468 by positioning the inner races of the bearings onto the shafts and securing them in position by bolted end plates 55*a* and 55*d*. It should also be noted that bearing housings 450*b* and 470*b* may be in the form of two separate elements, bodies 453, 473 and covers 454, 474. The bodies define the cylindrical surfaces 451, 471 received in bores 76*b*, 112*b* and are pinned against rotation by pins 455, 475 to covers 454, 474, which are, in turn, bolted to main frame wall 12*b*. These covers may be removed for access to end plates 55*a* and 55*d*.

On insertion of cylinders 46, 46*a* into position, shafts 52*a*, 52*d*, are passed into bores 76, 112 and the cylinders shifted axially toward main frame wall 12*a*. After proper alignment is achieved, the cylinders are shifted axially toward wall 12*b* and outer races of bearings 468 are received into bores 452, 472 of housings 450*b*, 470*b*. Thereafter, support housings 450*a* and 470*a* with bearings 468 in place within bores 452, 472 are slid onto shafts 52*a*, 52*d* and bolted to main frame wall 12*a*. Gears 54*a* and 54*d* may then be slid onto and secured to the shaft ends.

Assembly of cylinders 48, 48*a* into the press unit proceeds in a similar manner. First, internal support brackets 480*b* and 490*b* with bores 484, 494 empty are secured to the interior surface of frame wall 12*b*. Flanges 504, 505 may then be bolted together by bolts 506. To the ends of shafts 53*b*, 53*c* are assembled bearings 468, throw-off housings 486, 496, and throw-off bearings 485, 495. This is accomplished by sliding inner races of bearings 486 onto shafts 53*b*, 53*c* and securing them in place by bolted end caps 55*b* and 55*c*. As can be seen in FIG. 16, inner races of throw-off bearings 485, 495 are secured to throw-off housings 486, 496 by bolt rings 486*a*, 496*a*.

Cylinders 48, 48*a* are positioned between main frame walls 12*a*, 12*b* by passing shafts 52*b*, 52*c*, through bores 58*a*, 56*a*, or clearance bores 458, 456, and shifting the cylinder toward the main frame wall 12*a*. After aligning the cylinders, they are shifted axially toward wall 12*b* to dispose the outer races of throw-off bearings 485, 495 within the receiving bores 484, 494 of internal support housings 480*b*, 490*b*. The outers races of throw-off bearings 485, 495 are then secured within bores 484, 494 by bolted annular rings 486*b*, 496*b*.

External support brackets 480*a*, 490*a*, with throw-off bearings 485, 495, throw-off housings 486, 496, and cylinder support bearings 486 assembled within bores 484, 494 are next slid onto the ends of shafts 52*b*, 52*c* from the exterior of main frame wall 12*b*. Brackets 480*a* and 490*a* are then secured to main frame wall 12*a* by bolts 482, 492. Flanges 501, 502 of external support brackets may then be secured together with bolts 503. Gears 54*b*, 54*c* are then slid onto shafts 52*b*, 52*c*. They retain the inner races 468*b* (FIG. 17) of cylinder support bearings 468 onto the sahfts. The gears are, on assembly, placed into mesh with each other and with associated gears 54*a* and 54*d* of gear train 54. The gears 54*b* and 54*c* are secured onto shafts 52*b*, 52*c* by end caps 59*a* and 59*b*.

Throw-off mechanism 605 may then be positioned onto main frame 12 and throw-off levers 619 secured to throw-off housings 486, 496. Final adjustment of the spacing of plate cylinders 46, 46*a* is then made with radial adjustment locks 600. Blanket cylinders 48, 48*a* are then positioned in proper reference with each other and with respective plate cylinders 46, 46*a* by rotational movement of throw-off housings 486, 496 within internal support brackets 480*b*, 490*b* and external support brackets 480*a*, 490*a*. Linkings 625, 626 of throw-off mechanism 605 are adjusted to set the degree of movement of offset throwoff housings 486, 496 to move cylinders 48, 48*a* into the throw-off position.

The simplicity of the design of this latter embodiment results in lower costs for components, sub-assembly and installation.

The locations of the cylinder bearings, one bearing inside of one wall of the press frame and the other bearing outside of the other wall allows the distance between bearings to be no more than the original bearing spacing for letterpress operation, thus maintaining rigidity.

Location of the cylinder gears outside of the press frames allows space for longer printing cylinder bodies and maintains maximum web width.

With the cylinder gears and bearings mounted outside of the frames, the overhang of the gears is reduced to a minimum. This decreases the stresses in the cylinder shafts. Also, the gears are more accessible for inspection and can be replaced without removing the printing cylinders.

From the foregoing it will be seen that this invention is one well adapted to attain all of the ends and objects hereinabove set forth, together with other advantages which are obvious and which are inherent to the apparatus. It will be understood that certain features and subcombinations are of utility and may be employed without reference to their features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In an offset press unit having a main frame defining a pair of spaced apart walls including pairs of aligned bores adapted to receive and rotatably support a pair of plate cylinders, and two additional pairs of aligned bores spaced generally intermediate said pairs adapted to receive said plate cylinders, at least one of said pairs of aligned bores including bearing housings disposed therein and including cylinder support bearings therein, a pair of plate cylinders disposed inside said frame rotatably supported thereon in spaced apart relation, at least one of said plate cylinders being rotatably supported upon said cylinder support bearings of said bearing housings disposed in said at least one pair of aligned bores, and a pair of blanket cylinders disposed inside said frame, each rotatably supported for rolling contact with the other and with one of said plate cylinders at least a first non-rotatable internal support bracket secured inside the main frame to one of said walls and defining a bore eccentrically disposed with respect to each one of said pairs of aligned bores, at least a first a nonrotatable external support bracket secured outside the main frame to the other of said walls and defining a bore coaxially aligned with the bore defined by said internal support bracket, cylinder supporting bearings disposed in said bores of said internal and external support brackets, and one of said printing cylinders rotatably supported upon said cylinder supporting bearings, wherein said internal support bracket overlies one of said bores of one of said aligned pairs and includes a pilot disposed within said bore, said external support bracket overlying the other one of said same pair of aligned bores and including a pilot disposed within said bore, said internal and external support brackets rotatably supporting a blanket cylinder.

2. In an offset press unit as claimed in claim 1 wherein said cylinder supported by said cylinder supporting bearings of said internal and external support brackets includes a shaft passing through said wall of said main frame to which said external support bracket is attached, said shaft being rotatably supported by said cylinder supporting bearing of said external support bracket.

3. In an offset press unit as claimed in claim 2 wherein said wall of said main frame to which said external support bracket is secured defines a clearance bore to permit passage of said cylinder shaft therethrough.

4. In an offset press unit as claimed in claim 2 wherein each said printing cylinder includes a shaft passing through a separate bore in said wall to which said external support bracket is secured, and a gear train, including a separate gear attached to each said shaft in mesh with the gear on each adjacent shaft.

5. In an offset press unit as claimed in claim 1 including a rotatable throw-off housing disposed in each of said eccentrically disposed bores of said internal and external support brackets, said throw-off housings each defining a bore eccentrically disposed with respect to the bore in which said housing is received, said cylinder supporting bearings being disposed in said eccentrically disposed bores of said throw-off housings.

6. In an offset press unit as claimed in claim 1, including a second non-rotatable internal support bracket secured inside the main frame to the same wall as said first non-rotatable internal support bracket is secured, and defining a bore eccentrically disposed with respect to each one of said pairs of aligned bores, a second non-rotatable external support bracket secured outside the main frame to the same wall as said first non-rotatable external support bracket is secured and defining a bore coaxially aligned with the bore defined by said second internal support bracket, a cylinder supporting bearing disposed in each of said bores defined by said second internal and external support brackets, and a second of said printing cylinders rotatably supported upon said cylinder supporting bearings of said second internal and external support brackets.

7. In an offset press unit as claimed in claim 6 wherein said cylinders supported by said cylinder supporting bearings are said blanket cylinders.

8. In an offset press unit as claimed in claim 6 wherein said second internal support bracket overlies one of said bores of another of said aligned pairs of bores and includes a pilot disposed within said bore that said second internal support bracket overlies said second external support bracket overlies the other one of said same pair of aligned bores and includes a pilot disposed within said bore that said second external support bracket overlies, said second internal and external support brackets rotatably supporting another blanket cylinder.

9. In an offset press unit as claimed in claim 6 wherein each of said cylinders supported by said cylinder supporting bearings of said internal and external support brackets includes a shaft passing through said wall of said main frame to which said external support brackets are attached, said shafts being rotatably supported by said cylinder supporting bearings of said external support brackets.

10. In an offset press unit as claimed in claim 9 wherein said wall of said main frame to which said external support brackets are secured defines clearance bores to permit passage therethrough of said cylinder shafts.

11. In an offset press unit as claimed in claim 9 wherein each said printing cylinder includes a shaft passing through a separate bore in said wall to which said external support brackets are secured, and a gear train, including a separate gear attached to each said shaft in mesh with the gear on each adjacent shaft.

12. In an offset press unit as claimed in claim 6 including a rotatable throw-off housing disposed in each of said eccentrically disposed bores of said internal and external support brackets, said throw-off housings each defining a bore eccentrically disposed with respect to the bore in which said housing is received, said cylinder supporting bearings being disposed in said eccentrically disposed bores of said throw-off housings.

13. In an offset press unit as claimed in claim 12 including bearing housings disposed in each of said pairs of aligned bores of said main frame adapted to rotatably receive plate cylinders, bearing receiving bores formed in each said housings, cylinder supporting bearings disposed in each of said bores, said offset plate cylinders being rotatably supported upon said cylinder supporting bearings.

14. In an offset press unit as claimed in claim 13, wherein said bearing receiving bores defined by said bearing housings disposed in one of said pairs of aligned bores adapted to rotatably receive plate cylinders are eccentrically positioned with respect to said bores in which said housings are disposed.

* * * * *